US011502469B2

(12) United States Patent
Stewart

(10) Patent No.: US 11,502,469 B2
(45) Date of Patent: Nov. 15, 2022

(54) BRUSH HOLDER ASSEMBLY AND METHOD

(71) Applicant: TRANSPORTATION IP HOLDINGS, LLC, Norwalk, CT (US)

(72) Inventor: William E. Stewart, Greensburg, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 92 days.

(21) Appl. No.: 17/077,703

(22) Filed: Oct. 22, 2020

(65) Prior Publication Data

US 2021/0126415 A1 Apr. 29, 2021

Related U.S. Application Data

(60) Provisional application No. 62/926,183, filed on Oct. 25, 2019.

(51) Int. Cl.

| | |
|---|---|
| ***H01R 39/39*** | (2006.01) |
| ***H01R 43/14*** | (2006.01) |
| ***H01R 39/38*** | (2006.01) |

(52) U.S. Cl.

CPC ..... *H01R 39/39* (2013.01); *H01R 39/383* (2013.01); *H01R 43/14* (2013.01)

(58) Field of Classification Search

CPC ..... H01R 39/39; H01R 39/383; H01R 43/14; H01R 39/42; H01R 39/381; H01R 39/385

See application file for complete search history.

(56) References Cited

U.S. PATENT DOCUMENTS

| | | | | |
|---|---|---|---|---|
| 4,355,254 A * | 10/1982 | Oki | H01R 39/40 310/239 |
| 6,960,922 B2 * | 11/2005 | Klaar | H02K 5/14 356/450 |
| 8,546,993 B2 * | 10/2013 | Cutsforth | H01R 43/00 310/245 |
| 9,865,979 B2 * | 1/2018 | Eger | H01R 39/381 |

* cited by examiner

*Primary Examiner* — Oscar C Jimenez
*Assistant Examiner* — Paul D Baillargeon
(74) *Attorney, Agent, or Firm* — K&L Gates LLP

(57) ABSTRACT

A shunt extends from a brush received by a brush box of a brush holder. The first end of the shunt can be connected to the brush, and the second end of the shunt can connect to the brush holder. A lever connects to a back plate of the brush holder, and the lever may reversibly and selectively rotate between a first position and a second position; the lever can have a distal portion, and the second position of the lever secures a portion of the shunt between the distal portion of the lever and another component of the brush holder. The secured portion of the shunt can restrict downward movement of the brush in the brush box, while a spring pushes downward on the brush in the brush in the brush box, to thereby fixedly position the brush in the brush box.

16 Claims, 28 Drawing Sheets

BRUSH HOLDER ASSEMBLY AND METHOD

PRIORITY CLAIM

The present application claims priority to U.S. Provisional Application No. 62/926,183 filed Oct. 25, 2019, the entire contents of which are incorporated herein by reference.

BACKGROUND

Technical Field

Embodiments relate to a brush holder assembly and related methods.

Discussion of Art

Some rotary electromechanical devices, such as commutators or slip rings, and associated carbon brushes and holders are used in an industrial context, such as power generation. A spring may maintain constant contact between the brush and the rotary electromechanical device. Eventually, wear on the brush can hinder constant contact or secure positioning of the brush in the brush holder such that the brush must be replaced.

A brush holder holds a brush in place and may be configured for ease of replacing worn brushes. In some known brush holders, the spring applies force to the brush, while a movable brush catch selectively prevents downward movement of the brush. The brush catch in these known brush holders moves into contact with the brush to engage a bottom surface or a side surface of the brush, for example to apply a force to the bottom or side surface of the brush. However, the brush catch may not reliably secure the brush within the brush holder and instead may allow unintended movement of the brush within the brush holder. Moreover, the brush catch can potentially damage the brush, and the brush catch itself may be susceptible to damage.

BRIEF DESCRIPTION

Embodiments relate to assemblies that facilitate mounting and replacement of brushes that interact with a rotary electromechanical device. In one embodiment, the assembly can include a brush from which a shunt extends, and the brush can be received by a brush box of a brush holder. The shunt can have a first end and a second end that define a length of the shunt, the first end of the shunt can be connected to the brush, and the second end of the shunt can connect to the brush holder. The brush holder can include a back plate fixed to the brush box. A lever is connects to the back plate, and the lever may reversibly and selectively rotate between a first position and a second position; the lever can have a distal portion, and the second position of the lever secures a portion of the shunt between the distal portion of the lever and another component of the brush holder. The secured portion of the shunt can restrict downward movement of the brush in the brush box, while a spring pushes downward on the brush in the brush in the brush box, to thereby fixedly position the brush in the brush box.

A technical effect of one or more embodiments disclosed herein is to provide an improved brush holder assembly. Another technical effect of one or more embodiments disclosed herein is to enhance ease of brush mounting and replacement. Still another technical effect of one or more embodiments disclosed herein is to substantially fixedly position a brush in a brush holder when a handle is attached to the brush holder. The positioning may be done without applying force to a bottom surface or a side surface of the brush. In one embodiment, positioning may be done without any component of the brush holder abutting a bottom surface of the brush, and without pushing the brush against an inner surface of the brush box.

Another technical effect of one or more embodiments disclosed herein is an actuated lever that engages a brush shunt, instead of engaging the brush itself, to substantially fixedly position the brush in a brush holder when a handle is attached to the brush holder. One or more embodiments disclosed herein is a spring which applies force to a top surface of the brush and cooperates with a lever actuated by attachment of a handle to the brush holder to thereby substantially fixedly position the brush in the brush holder. An embodiment may automatically and reliably restrict and/or prevent vertical movement of a brush in a brush holder when a handle is attached to the brush holder and automatically and reliably allow vertical movement of the brush in the brush holder when the handle is removed from the brush holder.

Additional features are described herein and will be apparent from the following Detailed Description and the Figures.

DETAILED DESCRIPTION

Figure 1A:
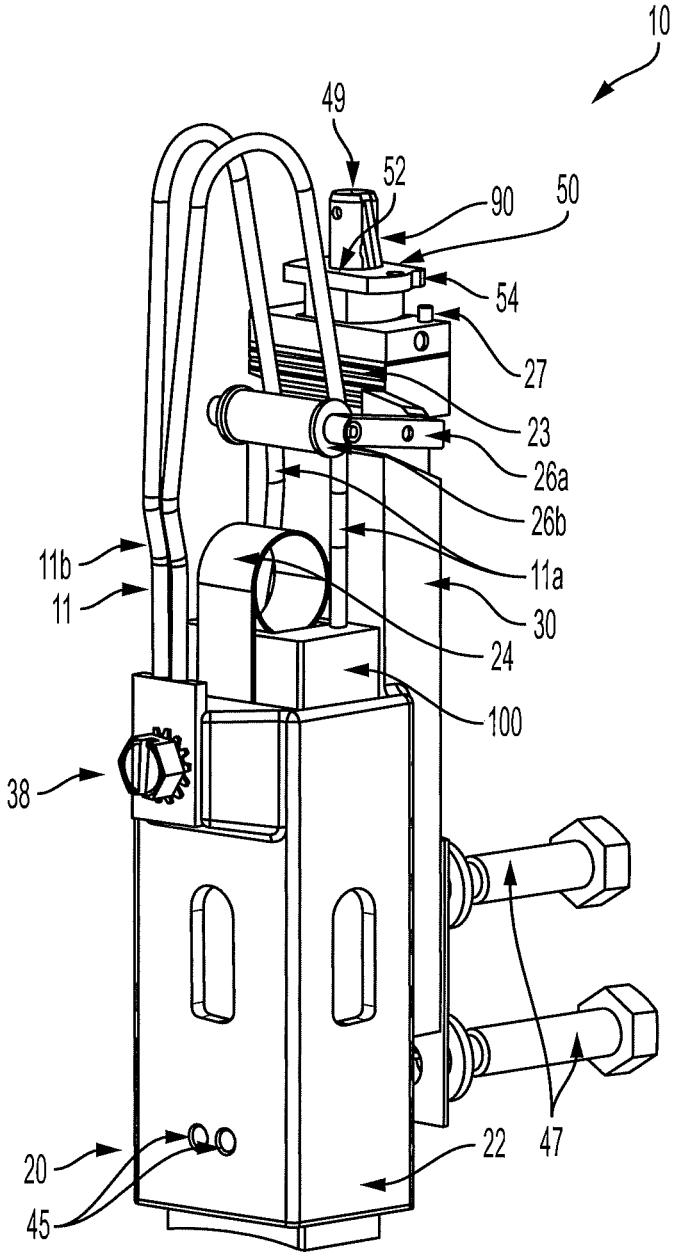
FIG. 1A shows a front perspective view of an embodiment of a brush holder assembly provided by the present disclosure, holding a brush.
Figure 1B:
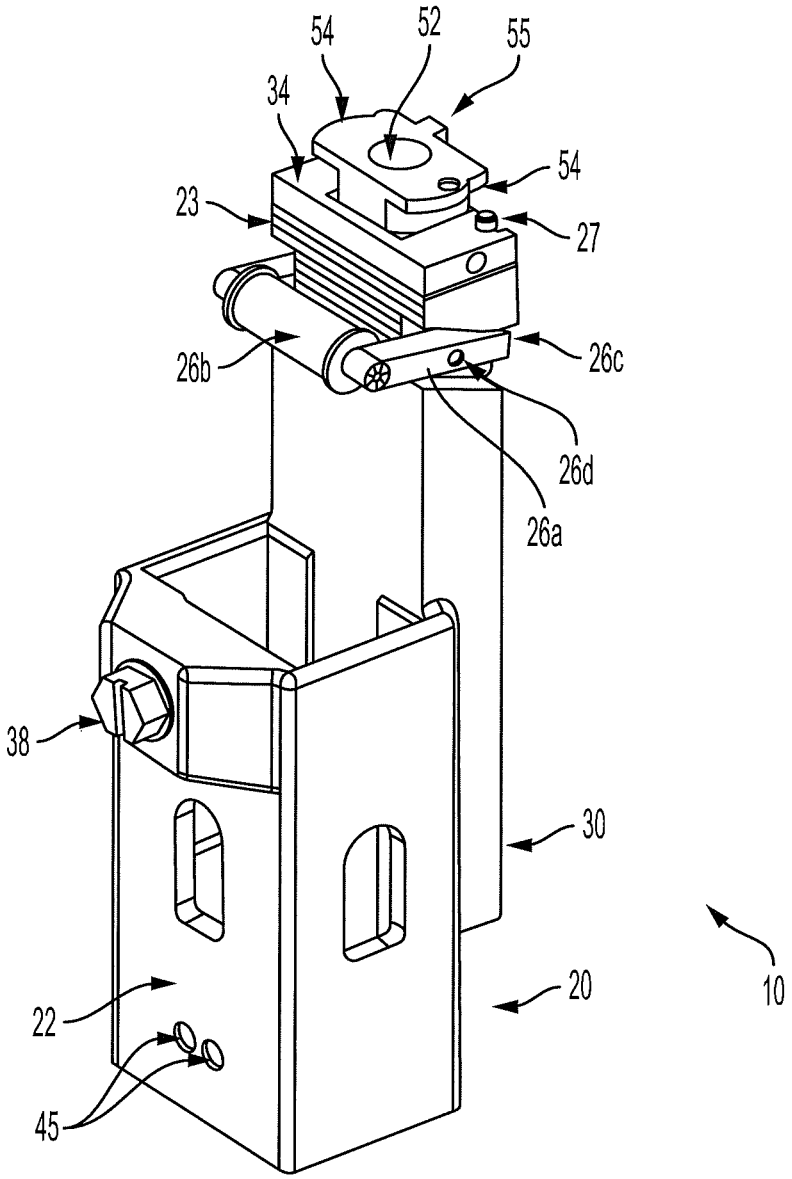
FIG. 1B shows a front perspective view of an embodiment of a brush holder assembly provided by the present disclosure, without a brush.
Figure 1C:
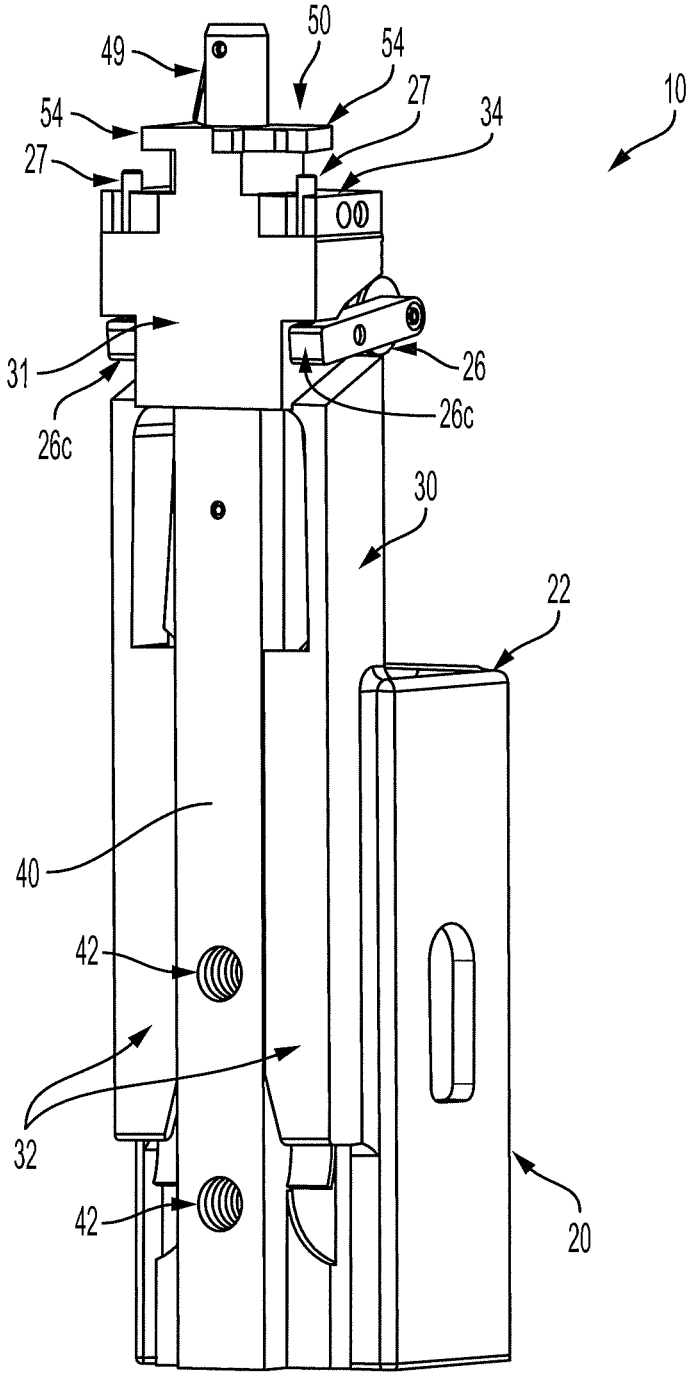
FIG. 1C shows a rear perspective view of an embodiment of a brush holder assembly provided by the present disclosure, with a support but without a brush.

Embodiments relate to a brush holder assembly and related methods. An embodiment of a brush holder assembly 10 provided by the present disclosure is generally illustrated in FIGS. 1A-1C. The assembly can include a brush holder 20, a support 40 and a handle 60. As shown in FIG. 1A, the assembly may can receive and retain a brush 100 and bias the brush toward a surface of a rotary device such as a commutator or slip ring. Suitable brushes may be formed from carbon, metal, or metal-filled polymer.

Referring again to FIG. 1A, the brush holder can include a brush box 22, a spring 24, and a back plate 30 which may be integral with the brush box. In the illustrated embodiment, the back plate is a rectangular cuboid. In other embodiments the back plate has a size and shape that is selected based at least in part on application specific parameters.

The brush box may receive at least a portion of the brush and at least partially support and restrain movement of the brush during operation. One or more side surfaces of the brush can abut a corresponding inner surface of the brush box. In an embodiment, the assembly does not have any component that applies a force to any side surface of the brush and does not have any component that abuts the bottom surface of the brush (herein, "side surfaces" of the brush do not include the top surface of the brush and do not include the bottom surface of the brush).

As shown in FIG. 1A, a shunt 11 may extend from the brush and can convey current from the brush. The shunt may be electrically conductive so as to conduct electricity to and/or from the surface of the rotary device through the brush. In one embodiment, the shunt includes braided copper cables. In another embodiment, the shunt may be dielectric to a determined degree.

Referring again to FIGS. 1A and 1B, the brush box may include an electrical connector 38 that can receive at least a portion of the shunt. For example, a first end of the shunt can connect to the brush, and a second end of the shunt can connect to the electrical connector. Although the electrical connector is depicted in the figures as a terminal screw, other suitable electrical connectors may be a quick-connect type terminal or another suitable component that provides an electrical connection to the shunt.

The brush holder includes a lever 26 that may selectively restrain movement of the brush in the brush box during installation of the brush or removal of the brush from the surface of the rotary device, as discussed in greater detail later herein. In one embodiment shown in FIG. 1A, the brush is positioned in the assembly such that the lever abuts a portion of the shunt. A first section 11*a* of the shunt extends between (i) the first end of the shunt, which is connected to the brush, and (ii) the portion of the shunt abutted by the lever. In this embodiment, a second section 11*b* of the shunt extends between (i) the portion of the shunt abutted by the lever and (i) the second end of the shunt, which is connected to the electrical connector. For example, the lever can selectively and reversibly move between a first position generally illustrated in FIGS. 1D, 1F and 2A and a second position generally illustrated in FIGS. 1E, 1G and 2B.

Figure 1D:
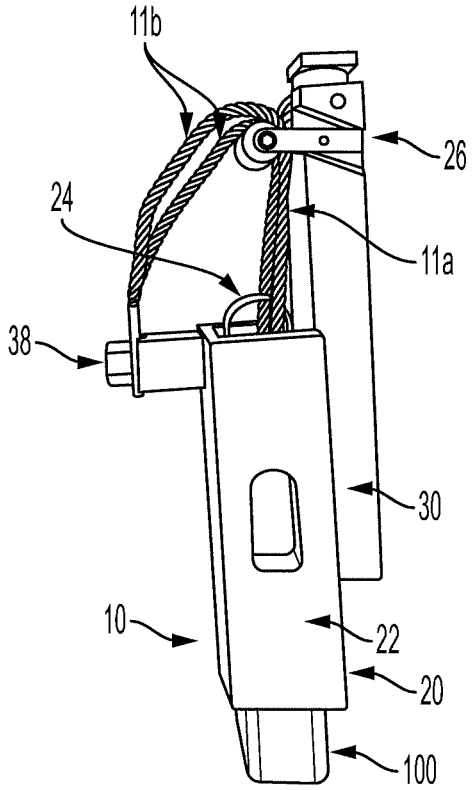
FIG. 1D shows a side plan view of a first position of a brush holder in which the brush shunt is not clamped by the lever, in the embodiment of a brush holder assembly provided by the present disclosure.
Figure 1E:
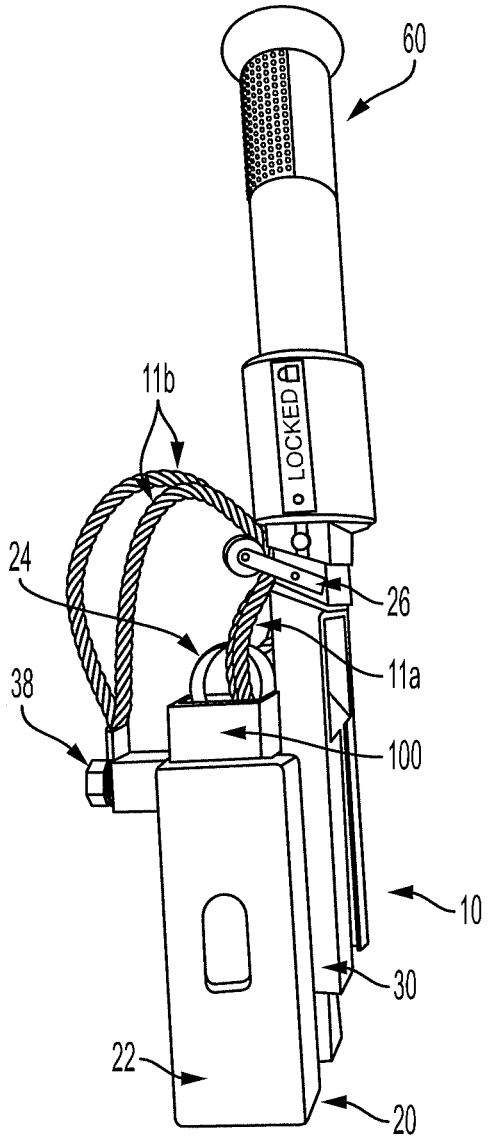
FIG. 1E shows a side plan view of a second position of the brush holder in which the brush shunt is clamped by the lever, in the embodiment of a brush holder assembly provided by the present disclosure.
Figure 1F:
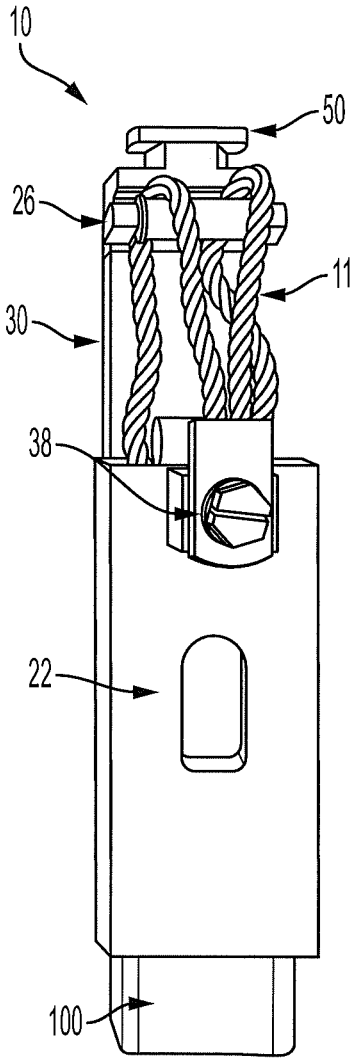
FIG. 1F shows a front plan view of the first position of a brush holder in which the brush shunt is not clamped by the lever, in the embodiment of a brush holder assembly provided by the present disclosure.
Figure 2A:
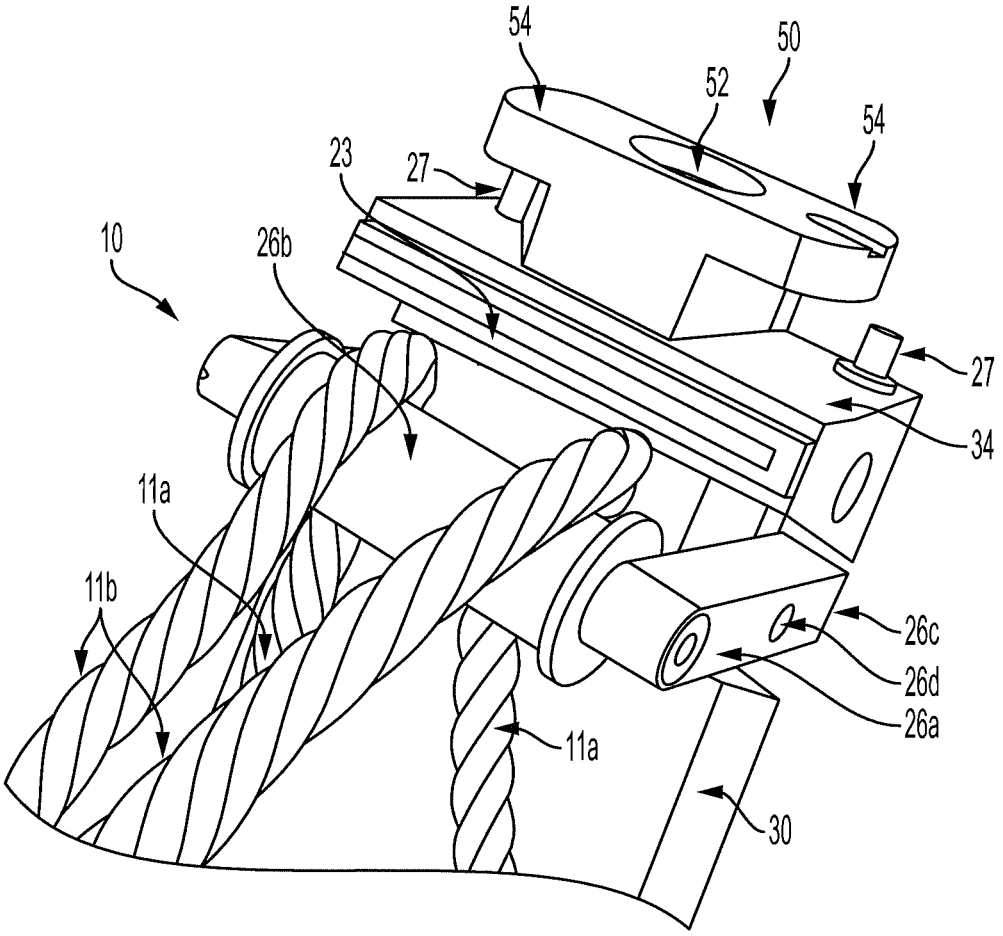
FIG. 2A shows a front perspective of the first position of the lever in which the brush shunt is not clamped by the lever, in the embodiment of a brush holder assembly provided by the present disclosure.

As shown in FIGS. 1D, 1F and 2A, the lever in the first position can selectively and reversibly establish a first configuration of the assembly, in which the portion of the shunt abutted by the lever is freely movable relative to the lever. In the first position of the lever and/or the first configuration of the assembly, the first section 11*a* of the shunt is slack (i.e., not taut) such that the shunt does not restrict downward movement of the brush in the brush box.

Figure 1G:
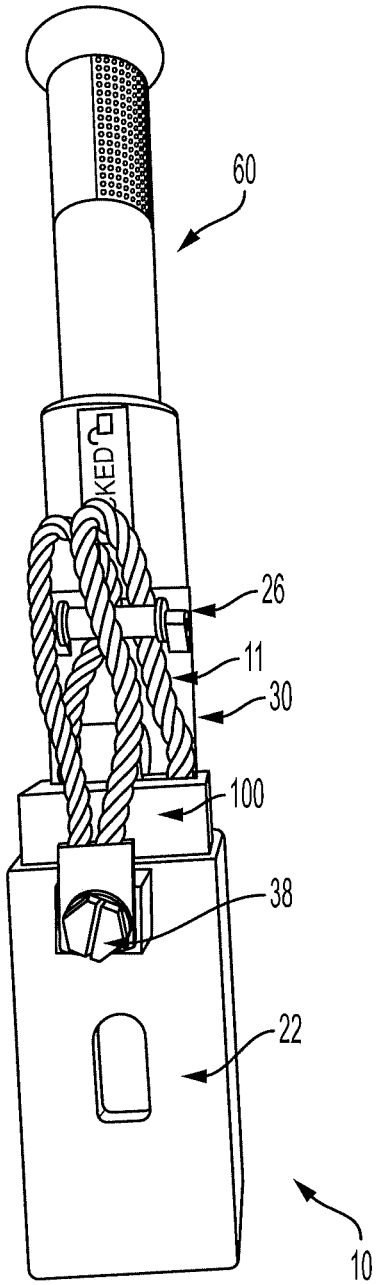
FIG. 1G shows a front plan view of the second position of the brush holder in which the brush shunt is clamped by the lever, in the embodiment of a brush holder assembly provided by the present disclosure.
Figure 2B:
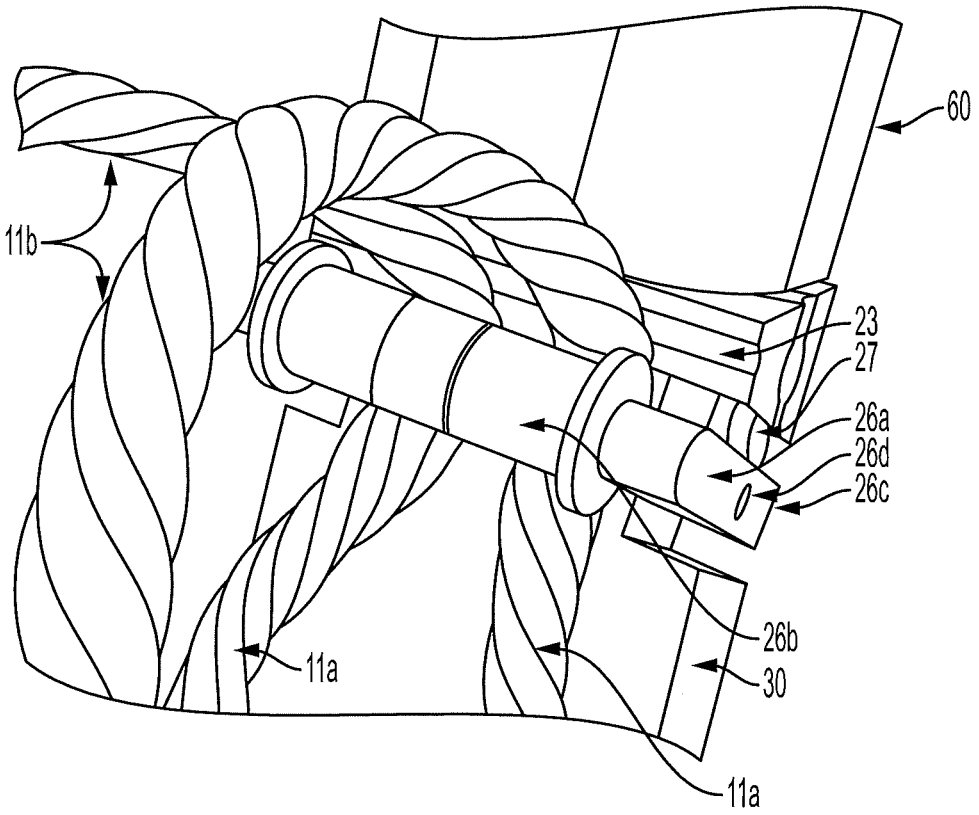
FIG. 2B shows a front perspective of the second position of the lever in which the brush shunt is clamped by the lever, in the embodiment of a brush holder assembly provided by the present disclosure.

As shown in FIGS. 1E, 1G and 2B, the lever in the second position can selectively and reversibly establish a second configuration of the assembly, in which the portion of the shunt abutted by the lever is secured between the lever and another component of the brush holder. In the second position of the lever and/or the second configuration of the assembly, the first section 11*a* of the shunt is taut such that the shunt restricts downward movement of the brush in the brush box.

The lever in the second position may press the shunt against a pad 23 on the back plate to thereby fixedly position the brush in the brush box, for example to fixedly position the brush in the brush box by cooperation with downward force from the spring on the brush. For example, the brush can be fixedly positioned in the brush box by downward force from the spring and restraint on downward movement by the shunt when the shunt is secured by the lever in the second position.

One or more side surfaces of the brush can abut a corresponding inner surface of the brush box. In one embodiment, three or four side surfaces of the brush abut a corresponding inner surface of the brush box ("side surfaces" of the brush, as used herein, do not include the top surface of the brush and do not include the bottom surface of the brush). In one embodiment, the fixed position of the brush may be maintained by the assembly without any component of the assembly abutting the bottom surface of the brush and without pushing any of the side surfaces of the brush.

In one embodiment, the pad has or defines a plurality of grooves or ridges formed in the back plate and can grip the portion of the shunt abutted by the lever when the portion of the shunt abutted by the lever is pressed against the pad by the lever. In one embodiment, the pad has a plurality of protrusions that can grip a portion of the shunt. In one embodiment, the pad can be integral with the back plate, for example as the same piece of material as the back plate. In other embodiments, at least a portion of the pad can be a different material than the back plate. Dissimilar materials can be selected to provide selective electrical conductivity (e.g., metal or metal filled polymer) or electrical resistance (e.g., alumina or non-filled polymer). Dissimilar materials can be selected to provide relatively extra grip or traction. Dissimilar material may be selected to provide additional wear resistance in spots that may be exposed to higher levels of contract or wear, or corrosion resistance.

In the embodiment illustrated in the figures, the first position of the lever can be substantially perpendicular to the back plate, and/or the second position of the lever can be positioned at an angle relative to the back plate that is not substantially perpendicular relative to the back plate, for example at an angle of approximately forty-five degrees relative to the pad. The angle of the lever in the second position can be selected or determined such that the angle is based on the thickness of the shunt to ensure that the second position of the lever secures the shunt against the pad. In one embodiment, the pad can be a component of the assembly against which the shunt is secured by the lever in the second position.

As shown in FIGS. 1A-1G, 2A and 2B, the lever may include one or more legs 26*a* and may further include a distal portion 26*b*. For example, one of the one or more legs 26*a* can be pivotally connected to the back plate on one side of the back plate, and another one of the one or more legs 26*a* can be pivotally connected to an opposite side of the back plate. In an embodiment, each of the one or more legs 26*a* is at least partially positioned in a corresponding groove on a side of the back plate.

The distal portion 26*b* of the lever may include a horizontal bar substantially perpendicular to each of the one or more legs 26*a*. In one embodiment, a horizontal bar connects to an end of each of the one or more legs 26 that is positioned distal from the back plate. When the brush is received by the brush box, a portion of the shunt between the first and second ends of the shunt may abut the distal portion of the lever. In an embodiment, the distal portion 26*b* is rotatably connected to the one or more legs such that the distal portion 26*b* rolls along the shunt as the lever moves between the first position of the lever and the second position of the lever.

A suitable shunt may include first and second braided copper cables. The distal portion 26*b* of the lever may include a horizontal bar comprising first and second grooves, the first groove of the horizontal bar can receive at least a portion of the first braided copper cable, and the second groove of the horizontal bar can receive at least a portion of the second braided copper cable.

In an embodiment, the distance between the distal portion of the lever and the pad is greater in the first position of the lever than the second position of the lever. A portion of the shunt abutted by the lever rests on at least the distal portion of the lever when the lever is in the first position, and the portion of the shunt abutted by the lever is fixedly positioned between the distal portion and the pad when the lever is in the second position. The distance of the distal portion from the pad when the lever is in the second position can be substantially equal to the thickness of the shunt (e.g., slightly less than the thickness of the shunt but still substantially equal to the thickness of the shunt) to ensure that the second position of the lever secures the shunt against the pad.

For example, as shown in FIGS. 1E, 1G and 2B, the second position of the lever can position at least a portion of the shunt in abutment with the distal portion of the lever on one side of the shunt and in abutment with the pad on the other side of the shunt. As a result, a non-damaging amount of pressure can be applied to each side of the portion of the shunt to fixedly position the portion of the shunt. Consequently, downward movement of the brush in the brush box may be restrained by the second position of the lever because the brush is attached to the first section 11*a* of the shunt.

The lever may be actuated by one or more pins 27 to retain the brush in the brush box. For example, the one or more pins can extend through an upper exterior surface 34 of the back plate, and/or the one or more pins can be positioned at least partially in the back plate.

The one or more pins can be pushed downward in the back plate, for example by the handle moving into abutment with the upper exterior surface of the back plate, to thereby push the lever from the first position to the second position. Movement of the lever from the first position to the second position can move a portion of the shunt into abutment with the pad.

The one or more pins can subsequently move upward, for example by the handle being removed from abutment with the upper exterior surface of the back plate and/or the one or more pins being spring-biased upward, to thereby return the lever to the first position from the second position. Movement of the lever back to the first position from the second position can release the portion of the shunt, which was previously secured against the pad, from abutment with the pad.

For example, the lever can include one or more proximal portions 26*c* opposite from the distal portion 26*b*, and the one or more legs 26*a* can connect to and/or define the one or more proximal portions 26*c*. The one or more legs 26*a* can have a pivot 26*d* between the distal portion 26*b* and the one or more proximal portions 26*c*. In an embodiment, each of the one or more proximal portions 26*c* is at least partially positioned in a corresponding groove on a side of the back plate, and each of the one or more proximal portions 26*c* may be aligned (e.g., at least vertically aligned) with a counterpart of the one or more pins.

The one or more pins can be moved downward in the back plate, for example by the handle moving into abutment with the upper exterior surface of the back plate such that the handle directly or indirectly pushes the one or more pins. Movement of the one or more pins downward in the back plate can cause the one or more pins to directly or indirectly push the one or more proximal portions 26*c* of the one or more legs 26*a* downward. As a result, pivoting of the one or more legs 26*a* on the pivot 26*d* can push the distal portion 26*b* upward, such that the lever moves from the first position to the second position.

The one or more pins can be moved upward in the back plate. The pins may move to their original position prior to connection of the handle to the back plate. For example, the pins may be moved by one or more of (i) the handle being removed from abutment with the upper exterior surface of the back plate such that the handle is removed from abutment with the one or more pins (or an intermediate component), (ii) the one or more pins being spring-biased upward, or (iii) the one or more proximal portions 26*c* being spring-biased upward. Movement of the one or more pins upward in the back plate can cause the one or more proximal portions 26*c* of the legs 26*a* to move upward. As a result, pivoting of the legs 26*a* on the pivot 26*d* can push the distal portion 26*b* downward, such that the lever moves from the second position to the first position.

The brush may be fixedly positioned in the brush box by downward force from the spring and restraint on downward movement by the shunt when the shunt is secured against the pad by the lever in the second position. The spring may be a ribbon spring or another biasing member and may be attached to at least one of the brush box or the back plate. As shown in the figures, the spring may attach to the front of the brush box, for example by rivet holes 45 in the front of the brush box. When the brush is positioned within the brush box, the spring contacts a top surface of the brush to nominally bias the brush toward the surface of the rotary device. As the brush experiences wear, the spring can roll upon itself to continuously bias the brush toward the surface of the rotary device.

Figure 3A:
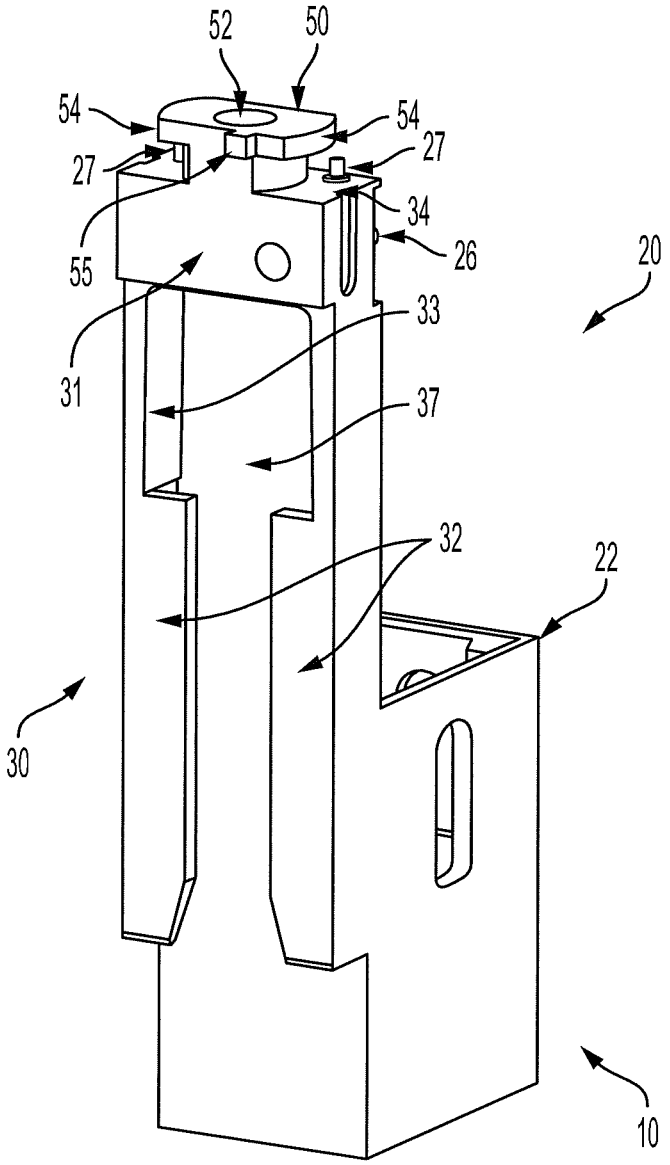
FIG. 3A shows a rear perspective view of a brush holder in an embodiment of a brush holder assembly provided by the present disclosure.

As shown in FIG. 3A, the back plate may include extensions 32 that can receive the support. The figures show two of the extensions, but any number of the extensions can be used. A connecting member 50 may be positioned on the upper exterior surface of the back plate. The connecting member may be integral with and/or fixedly connected to the upper exterior surface of the back plate.

Figure 3B:
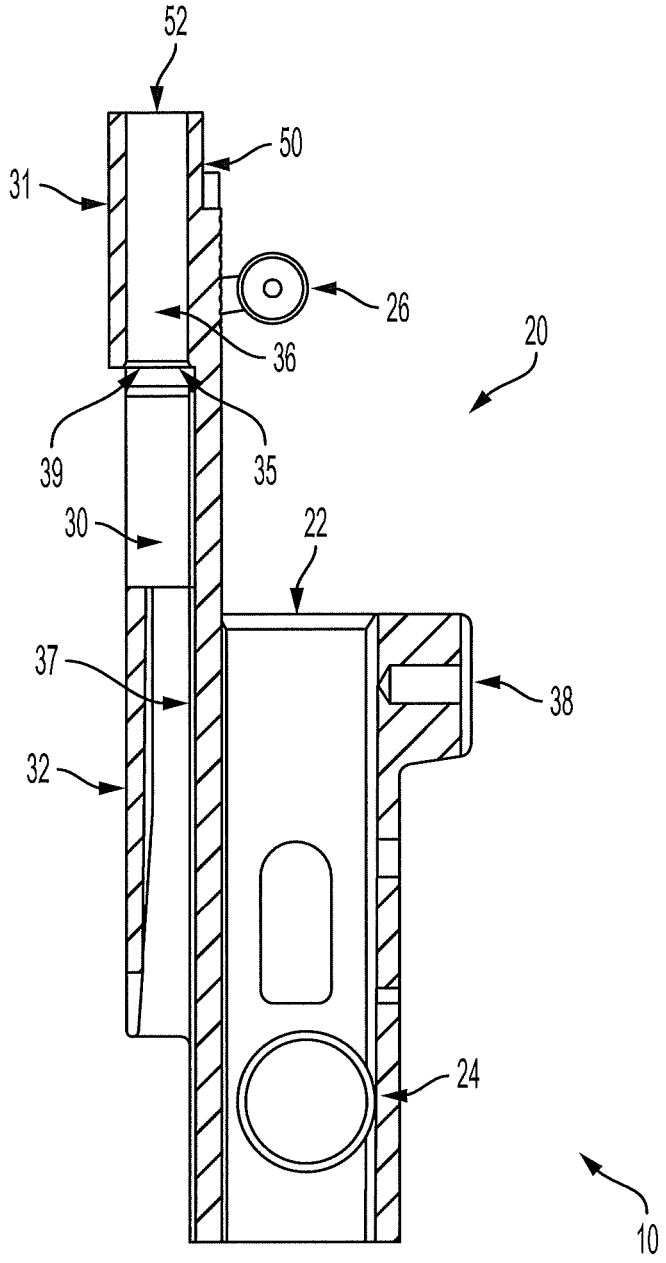
FIG. 3B shows a side cross-section view of a brush holder in an embodiment of a brush holder assembly provided by the present disclosure.

As shown in FIG. 3B, a central bore 36 can form an opening 52 in the connecting member and an opening 39 in the upper interior surface 35 of the back plate. The central bore can extend from the opening in the connecting member, through the connecting member and the back plate, to the opening in the upper interior surface of the back plate. The connecting member may include a locking flange 54 that horizontally extends from opposite sides of the connecting member. A boss 55 may horizontally extend from one of the other sides of the connecting member.

Figure 4C:
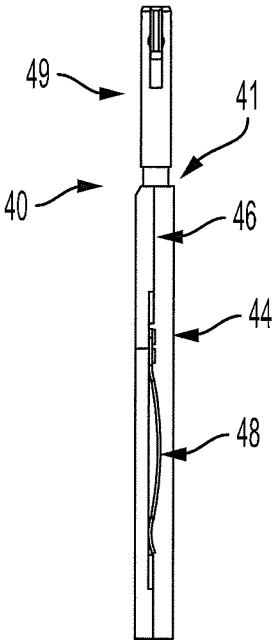
FIG. 4C shows a side plan view of a support in an embodiment of a brush holder assembly provided by the present disclosure.
Figure 4B:
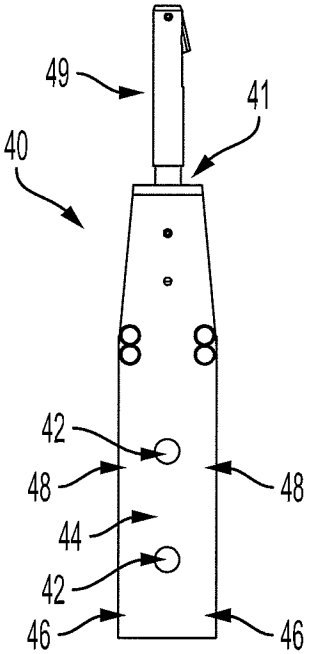
FIG. 4B shows a rear plan view of a support in an embodiment of a brush holder assembly provided by the present disclosure.
Figure 4A:
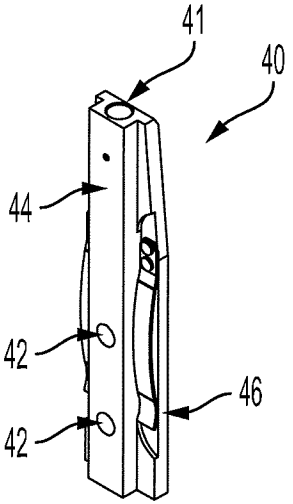
FIG. 4A shows a rear perspective view of a support in an embodiment of a brush holder assembly provided by the present disclosure.

As shown in FIGS. 4A and 4B, the support 40 may include one or more bores 42 that may be configured to receive a bolt (shown in FIG. 1A as bolt 47) or another fastener to fixedly connect the support in a desired position. The one or more bores can receive a brush-changing handle (not shown) instead of a bolt or fastener if the support will be used to install a new or replacement brush.

As shown in FIGS. 4A-4C, the support may include a body 44. The one or more bores 42 may extend through the body. The support may include a support flange 46 that extends from opposite sides of the body, and the support flange and the body may form a T-shaped cross-section when viewed from above or below (see FIG. 3A).

Referring again to FIG. 1C, the support may be received by the brush holder. An upper interior surface 35 of the back plate, a rear interior surface 37 of the back plate, interior sides 33 of the back plate, and the extensions may form a chamber that receives the support. The support may be received with the top surface 41 of the support abutting and/or proximate to the upper interior surface of the back plate and/or with the front surface 43 of the support abutting and/or proximate to the rear interior surface 37 of the back plate. The extensions and the rear interior surface may maintain this position of the support therebetween. To ensure a tight fit between the support and the back plate, the distance between the extensions of the back plate may be substantially the same as the width of the body, and/or the width of the support flange may be substantially the same as the width of the rear interior surface of the back plate.

As shown in FIGS. 4B and 4C, the support flange may include one or more contact springs 48, for example a pair of springs with one spring on each side of the body. The one or more contact springs can bias against the extensions when the support is positioned within and/or against the back plate. The contact spring may maintain a position on the support within and/or against the back plate. The contact spring may provide consistent electrical contact between the brush holder and the support. In other embodiments, the back plate may include the one or more contact springs such that the one or more contact springs bias against the support. The back plate may be removed from the support by external force greater than the bias force of the one or more contact springs, for example by a user sliding or pulling the back plate upward relative to the support. The support may be connected to the back plate using a mechanism selected based at least in part on the end use application. Suitable springs include leaf springs, coiled springs, or other biasing members. In one embodiment, a spring-within-a-spring arrangement (not shown) provides increased bias when the inner spring is employed.

As shown in FIGS. 4B and 4C, the support can include a post 49 that is integral with and/or fixedly connected to the top surface 41 of the support. FIG. 4A does not show the post so that the T-shaped cross-section of the support can be clearly seen, but this figure is not a different embodiment of the support. Other suitable post conformations may include an "L", "Y", and "I" shaped post. Yet other suitable conformations may be selected based on application specific requirements.

In one embodiment, the central bore has a length (the distance from the opening in the connecting member to the opening in the upper interior surface of the back plate) that is less than the length of the post. The post may completely extend through the central bore as shown in FIG. 1A. In one embodiment, at least a portion of the central bore and at least a portion of the post have complementary cylindrical shapes. For example, the central bore may have a radius and/or a circumference substantially the same as the radius and/or the circumference of the post, respectively. The post can interact with the handle as discussed in greater detail hereafter.

As shown in FIGS. 5A-5D, the handle may include a stem 62 and may include a shell 64 that forms a base of the handle. In an embodiment, the handle can be connected to the back plate by a user in a process comprising positioning the shell in abutment with the upper exterior surface of the back plate. Positioning the shell in abutment with the upper exterior surface of the back plate includes the shell pushing the one or more pins downward in the back plate to thereby have the one or more pins push the proximal portions 26*c* of the one or more legs 26*a* of the lever downward, such that the lever moves from the first position to the second position to secure the shunt against the pad.

The stem may be fixedly connected to the shell so that rotation of the stem rotates the shell. For example, one or more threads 61 on the stem may mate with complementary threads 63 on the shell, although any connection known to one of ordinary skill may be used. The stem may include insulation 65 that may enable the handle to be attached, used and removed while the rotary device is energized or rotating. In one embodiment, the shell maintains the one or more pins on their downward position during rotation of the handle, to thereby maintain the lever in the second position which secures the shunt against the pad.

The handle can include a cavity 66 within the shell and can further include a core 70 moveably positioned in the cavity. The shell, including shell teeth 78 at the bottom of the shell, and the core enable the handle to receive and connect to the connecting member which is part of the back plate of the brush holder as discussed in detail hereafter. Preferably, the inside diameter of the cavity is substantially the same as the outside diameter of the core. The height of the cavity is such as to allow the core to travel within the cavity to facilitate selective engagement of the core with the locking flange.

The shell of the handle can include a stop 79 extending downward from the shell. The stop can abut the rear exterior surface of the back plate of the brush holder when the handle is connected to the back plate. The core may include a recess 80 on the bottom surface of the core, and the recess may be a vertical cylindrical recess having a central axis along the vertical axis of the core and/or the vertical axis of the handle. The recess has a radius and/or a circumference that is substantially the same as the radius and/or the circumference of the post, respectively. The core may include core teeth 74 that extend downward from the bottom surface of the core on opposite sides of the recess. In one embodiment, the distance between the core teeth is substantially the same as the width of the locking flange.

The shell teeth can extend inward from opposite inner sides of the shell in a direction that is substantially horizontal. The shell teeth may not vertically overlap the core teeth. In one embodiment, the inner diameters and widths of the shell teeth are substantially the same as the outer dimensions of the locking flange.

A compression spring 72 may be positioned at least partially within the cavity and may extend from the stem to abut the top surface of the core. Force upon the bottom of the core may slide the core upward within the cavity, but the compression spring nominally biases the core downward in the cavity against the top of the shell teeth in a resting state. In an embodiment, the compression spring nominally biases the core downward such that the shell teeth are in substantially the same horizontal plane as the core teeth. The core can optionally include a pin 76 that extends outward horizontally from the core into a slot 81 in the shell.

Figure 5A:
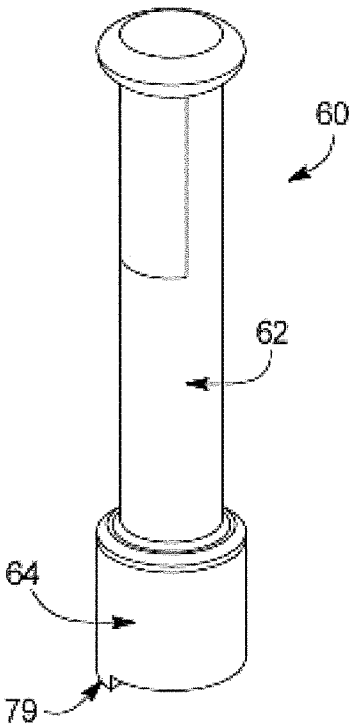
FIG. 5A shows a front perspective view of a handle in an embodiment of a brush holder assembly provided by the present disclosure.
Figure 5B:
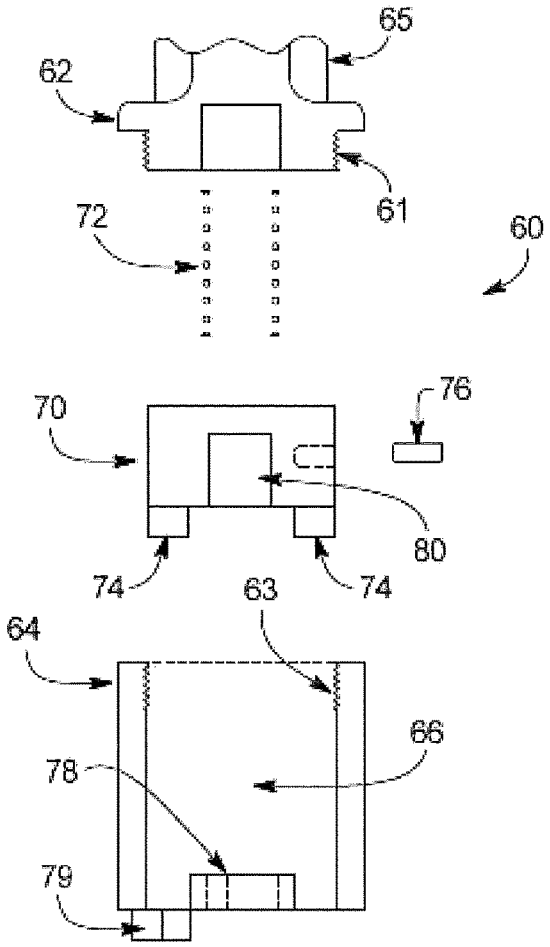
FIG. 5B shows an exploded view of a handle in an embodiment of a brush holder assembly provided by the present disclosure.
Figure 5C:
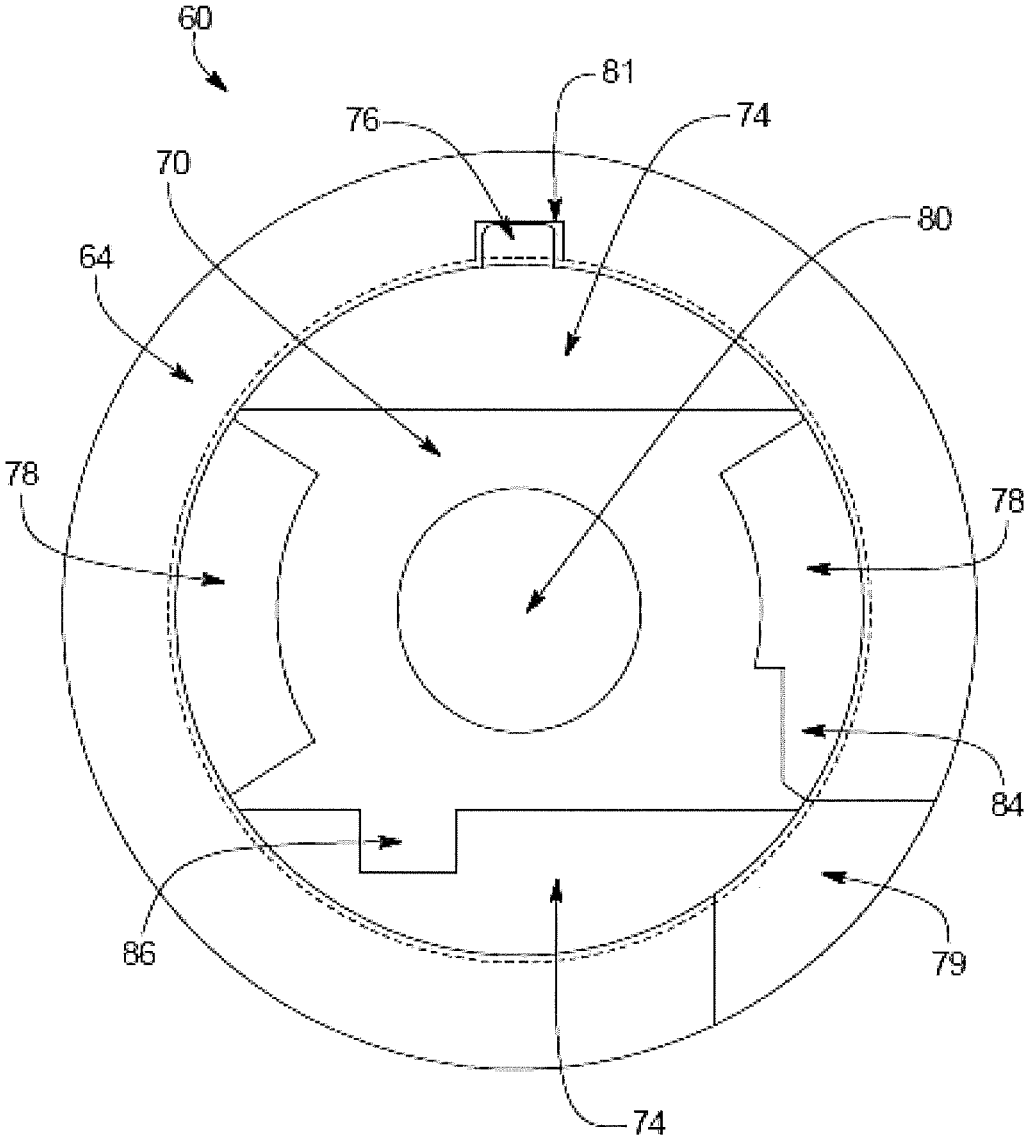
FIG. 5C shows a bottom plan view of a handle in an embodiment of a brush holder assembly provided by the present disclosure.
Figure 5D:
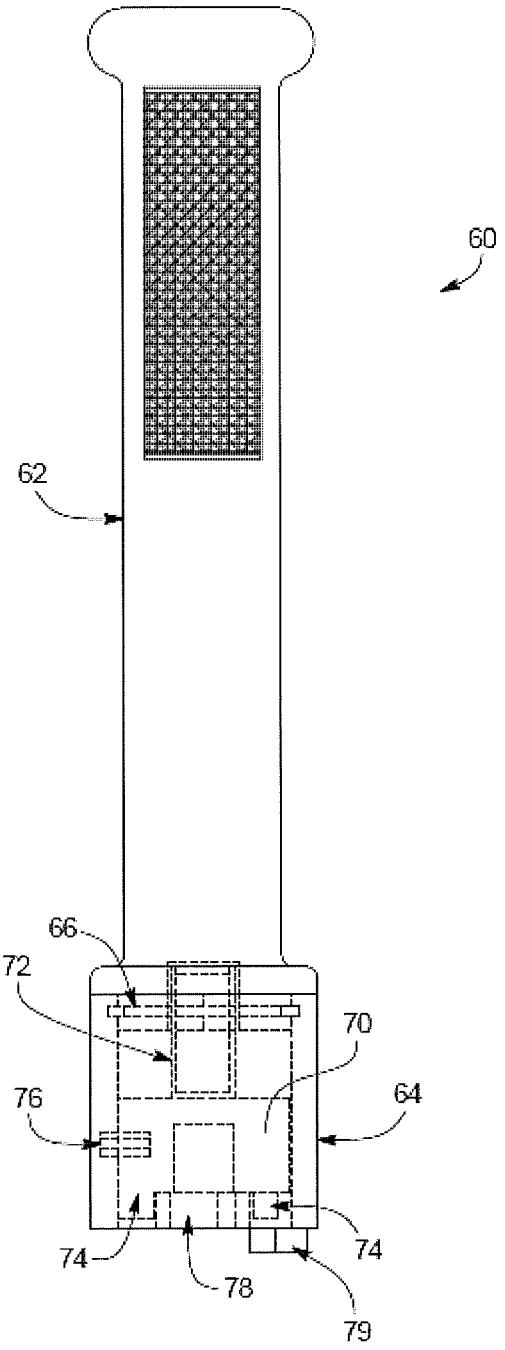
FIG. 5D shows a side cross-section view of a handle in an embodiment of a brush holder assembly provided by the present disclosure.
Figure 5E:
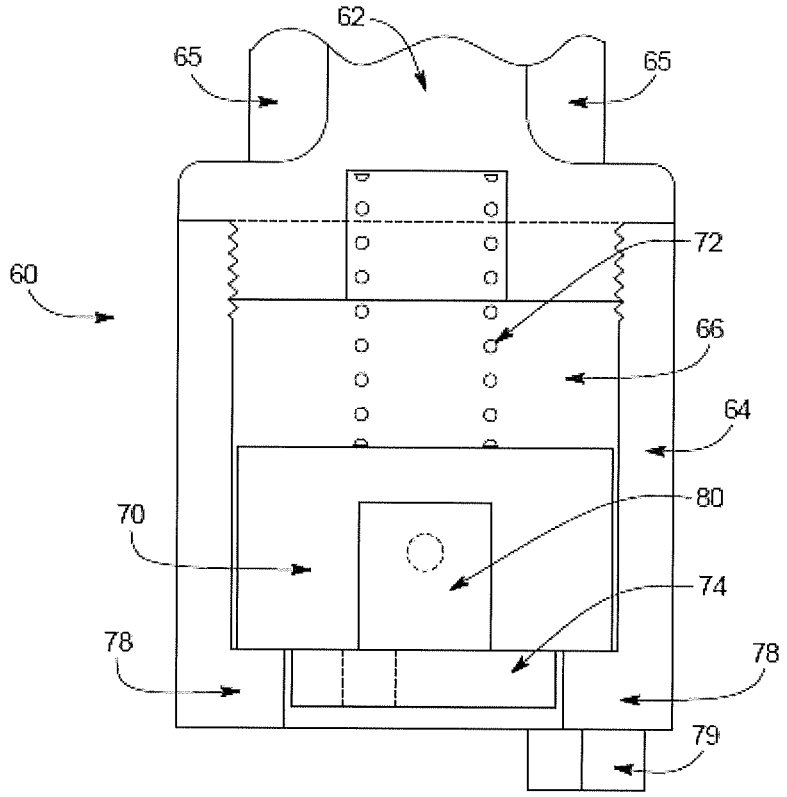
FIG. 5E shows a cross-section view, from the front of the brush holder, of a handle in the locked position in an embodiment of a brush holder assembly provided by the present disclosure.
Figure 5F:
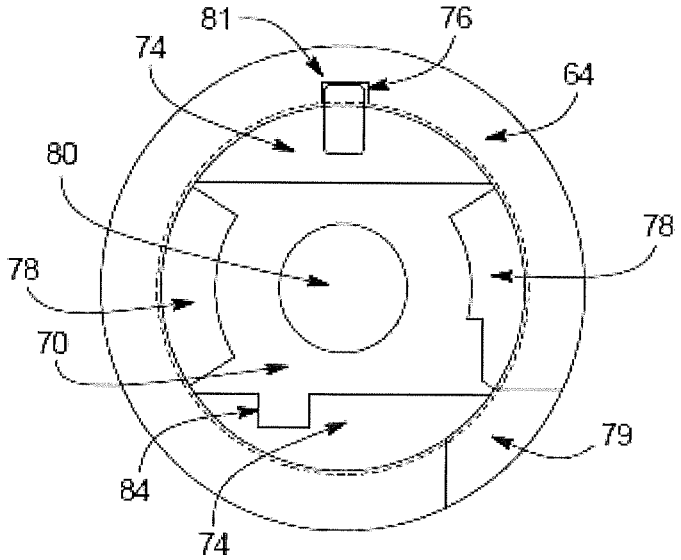
FIG. 5F shows a bottom cross-section view of the locked position of the handle shown in FIG. 5E.
Figure 5G:
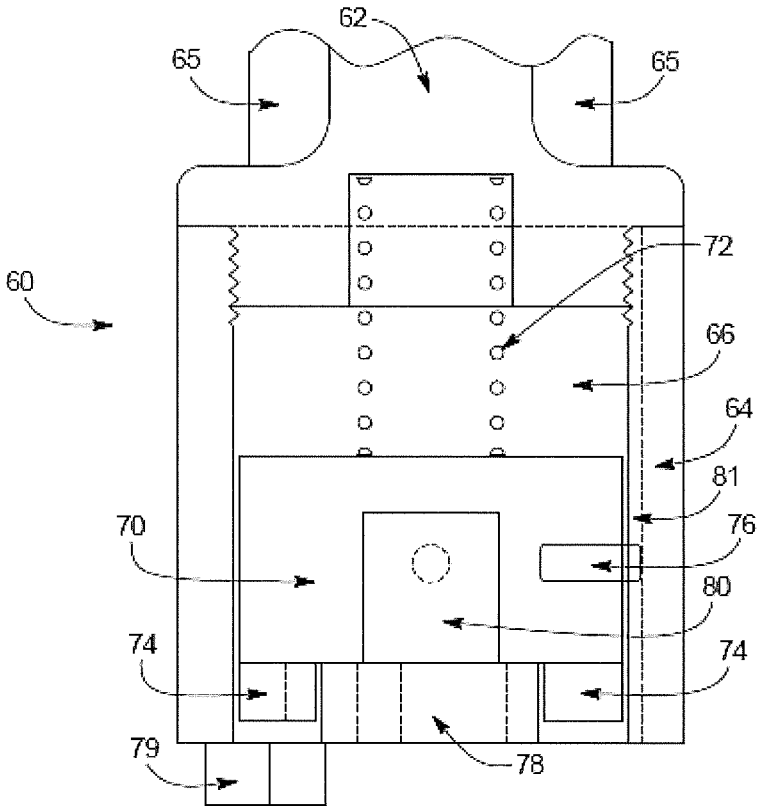
FIG. 5G shows a cross-section view, from the front of the brush holder, of a handle in an unlocked position in an embodiment of a brush holder assembly provided by the present disclosure.
Figure 5H:
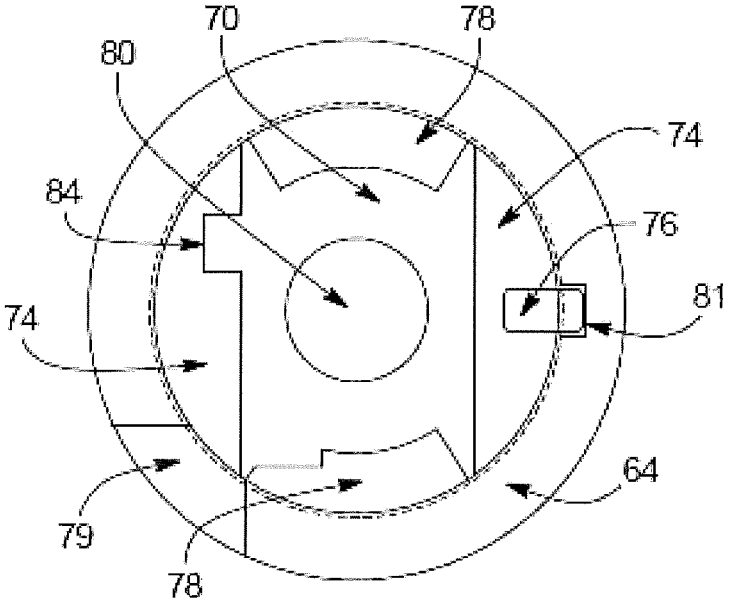
FIG. 5H shows a bottom cross-section view of the unlocked position of the handle shown in FIG. 5G.

FIGS. 5E and 5F show the handle in an orientation as viewed from the front of the brush holder, and this orientation would lock the handle to the brush holder. In an embodiment, the locked position of the handle situates the core teeth in the front and the rear of the cavity relative to the front of the brush holder and situates the shell teeth on the lateral sides of the cavity. FIGS. 5G and 5H show the handle in an unlocked orientation, as viewed from the front of the brush holder; the handle is shown mounted to the brush holder in this view. In an embodiment, the unlocked position of the handle situates the shell teeth in the front and the rear of the cavity relative to the front of the brush holder and situates the core teeth on the lateral sides of the cavity. The handle may be rotated by approximately ninety degrees to move from the unlocked position to the locked position and rotated in the opposite direction by approximately ninety degrees to return to the unlocked position. Movement of the handle between the locked position and the unlocked position is discussed in further detail hereafter in reference to FIGS. 8A-L and 9A-H.

Figure 6A:
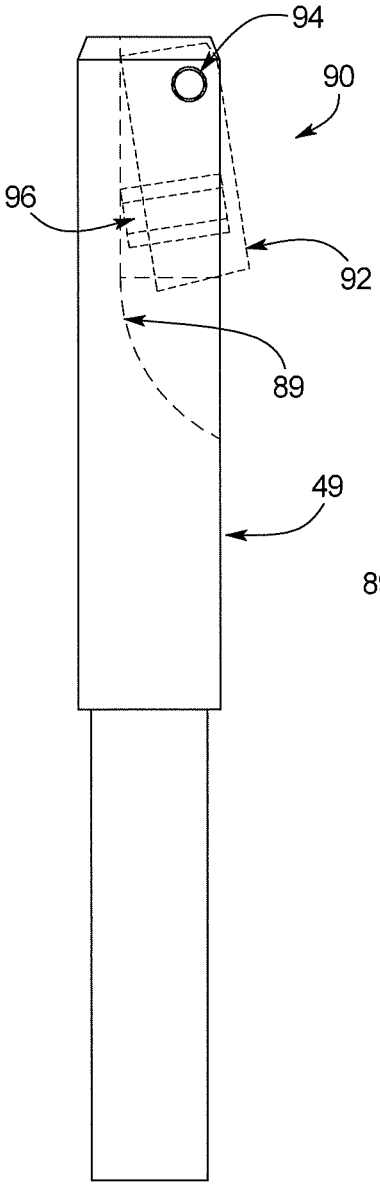
FIG. 6A shows a side plan view of a post provided by the support in an embodiment of a brush holder assembly provided by the present disclosure.
Figure 6B:
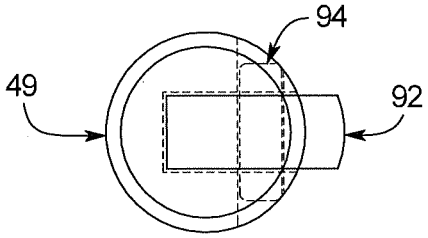
FIG. 6B shows an above plan view of a post provided by the support in an embodiment of a brush holder assembly provided by the present disclosure.
Figure 6C:
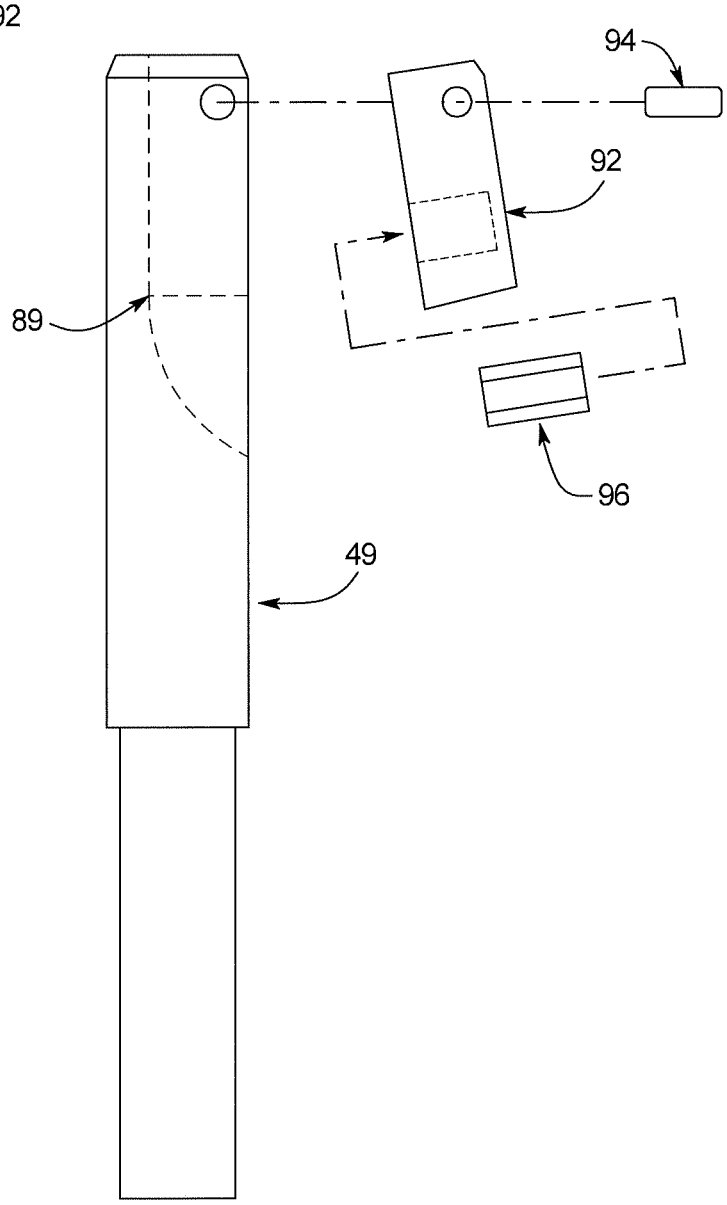
FIG. 6C shows an exploded view of a post provided by the support in an embodiment of a brush holder assembly provided by the present disclosure.

As shown in FIGS. 6A-6C, the post can include a rocker assembly 90. A portion of the post can extend out of the connecting member when the support is connected to the brush holder, and this portion of the post can include a slot 89 in which the rocker assembly can be positioned. For example, the bottom of the rocker assembly can be positioned on the post at a distance from the top surface 41 of the support that is at least equal to the length of the central bore.

The rocker assembly can include a rocker arm 92, a pin 94 that connects the rocker arm to the post, and a rocker spring 96 positioned at least partially between the post and the rocker arm. The rocker arm can rotate on the pin, and the rocker spring can nominally bias the bottom end of the rocker arm outward such that the bottom end of the rocker arm extends outward from the slot 89 in a resting state.

Figure 7A:
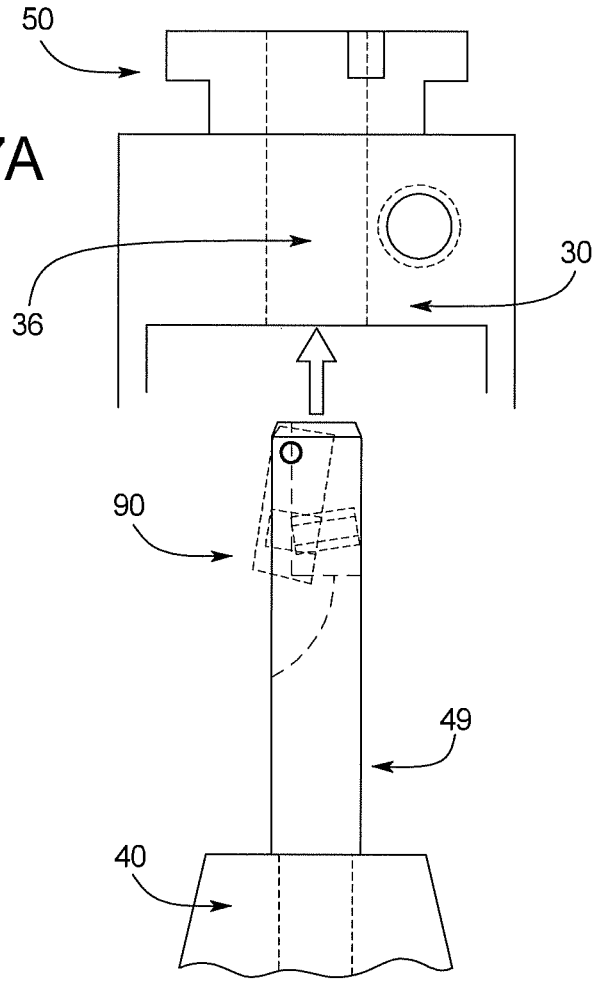
FIG. 7A shows a rear cross-section view of a support and a brush holder before their connection in an embodiment of a brush holder assembly provided by the present disclosure.

FIGS. 7A-7D generally illustrate attachment of the support to the back plate of the brush holder in the absence of the handle. As shown in FIG. 7A, the post of the support can be aligned with the central bore of the back plate of the brush holder to prepare for connection of the support to the back plate. The bottom end of the rocker arm is rotated outward from the slot of the post by the rocker spring in this resting state of the rocker assembly.

Figure 7B:
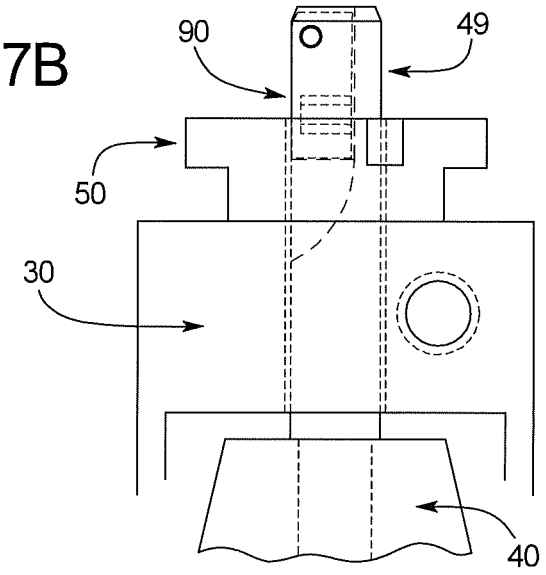
FIG. 7B shows a rear cross-section view of a brush holder partially seated on a support in an embodiment of a brush holder assembly provided by the present disclosure.

As shown in FIG. 7B, the post of the support is inserted into the central bore as the support connects to the back plate. The bottom end of the rocker arm is rotated inward into the slot of the post by a restrictive circumference of the central bore, which compresses the rocker spring.

Figure 7C:
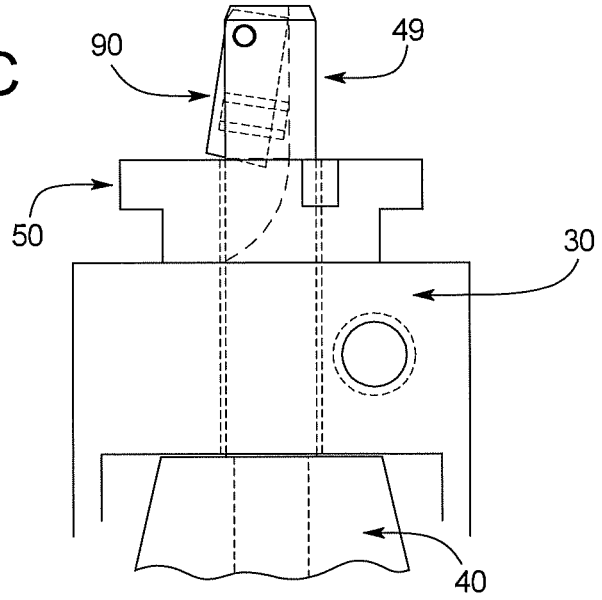
FIG. 7C shows a rear cross-section view of a brush holder fully seated on a support in an embodiment of a brush holder assembly provided by the present disclosure.
Figure 7D:
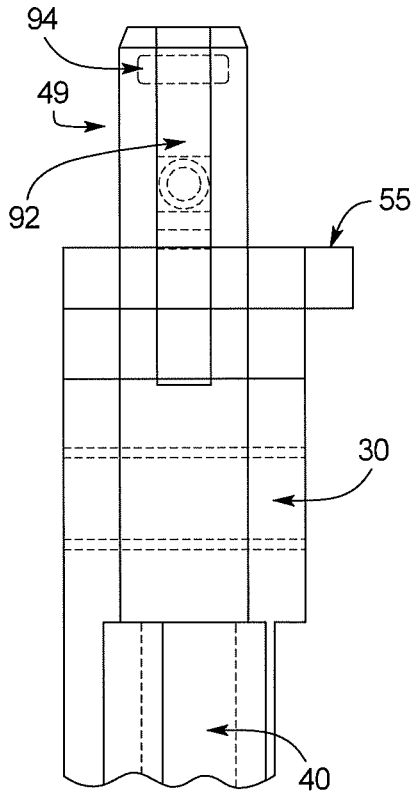
FIG. 7D shows a side cross-section view of a support and a brush holder after their connection in an embodiment of a brush holder assembly provided by the present disclosure.

As shown in FIGS. 7C and 7D, a portion of the post extends from the central bore after the support is fully connected to the back plate. The bottom end of the rocker arm is rotated outward from the post by the emergence of the rocker arm from the central bore, which frees the rocker assembly from the restrictive circumference of the central bore and allows the rocker spring to extend. Extension of the rocker arm outward from the post provides a visual indication that the brush holder is fully seated on the support and locks the brush holder to the support.

FIGS. 8A-8L generally illustrate connection of the support, the brush holder, and the handle to each other. These figures also depict a first method provided by the present disclosure. The steps disclosed hereafter can be performed in any order and are not limited to the specific order shown in the figures. In these figures, the outer dashed line is the perimeter of the locking flange 54, and the inner, circular dashed line is the perimeter of the connecting member.

Figure 8A:
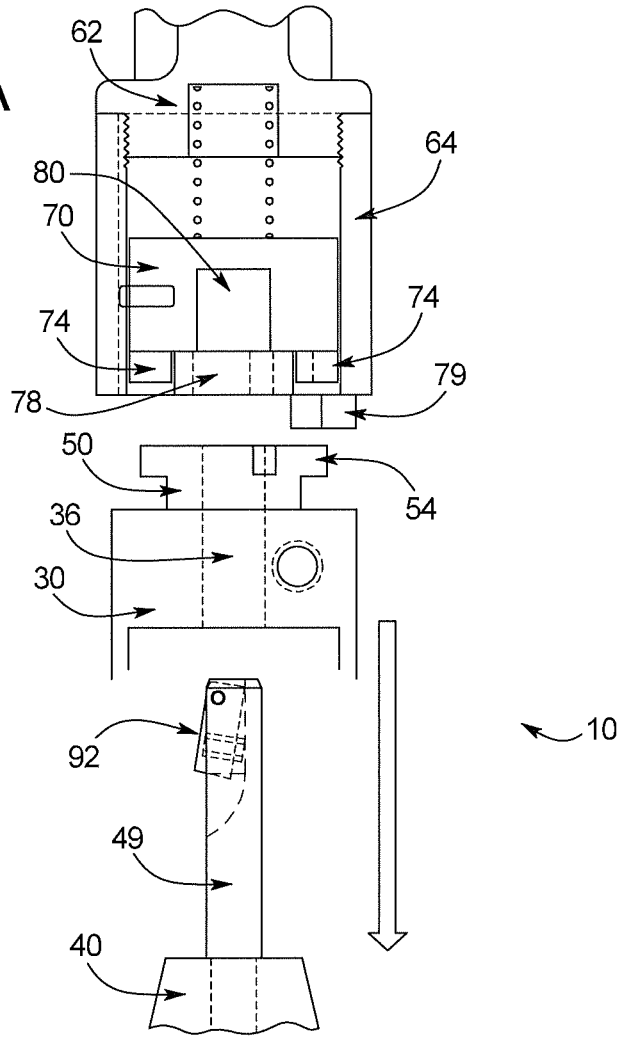
FIG. 8A shows a rear cross-section view of an embodiment of a brush holder assembly provided by the present disclosure.
Figure 8B:
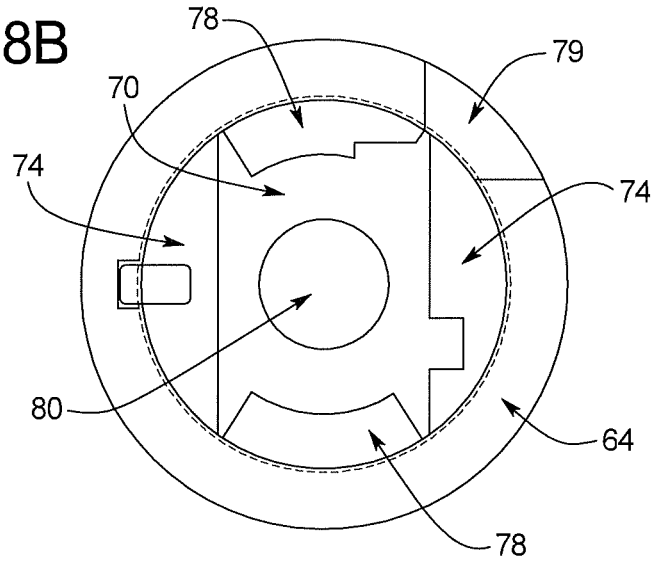
FIG. 8B shows a bottom cross-section view of the configuration of the embodiment of a brush holder assembly shown in FIG. 8A.

As shown in FIGS. 8A and 8B, which depict step (1) of the first method, a user can align the handle with the connecting member and/or align the support with the back plate of the brush holder. Then the back plate can be moved onto the support.

Figure 8C:
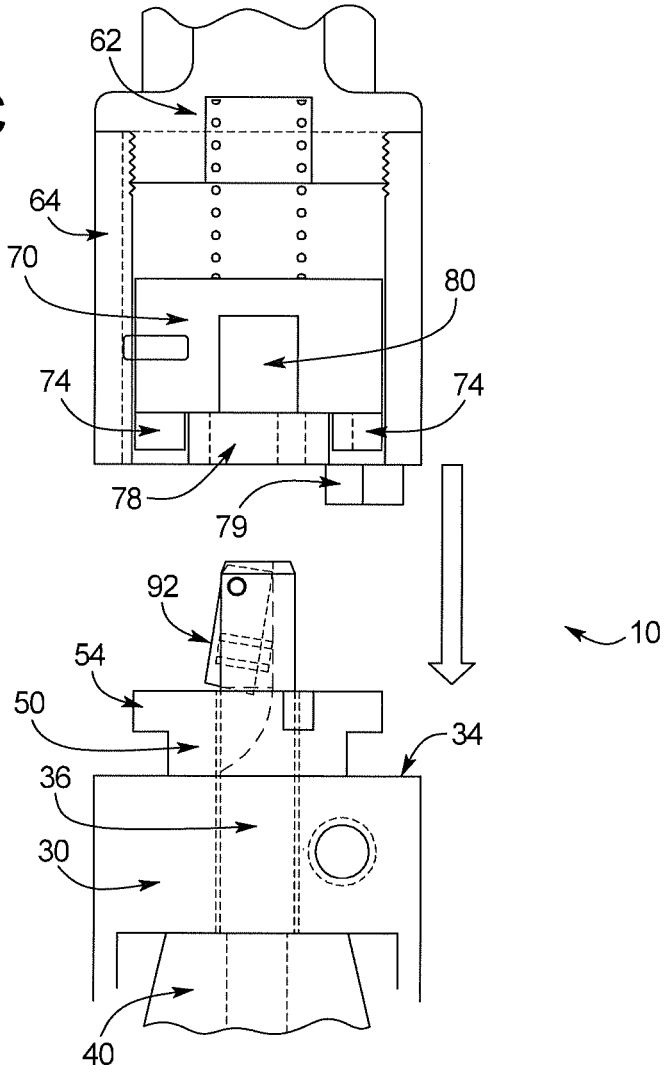
FIG. 8C shows a rear cross-section view of an embodiment of a brush holder assembly provided by the present disclosure.
Figure 8D:
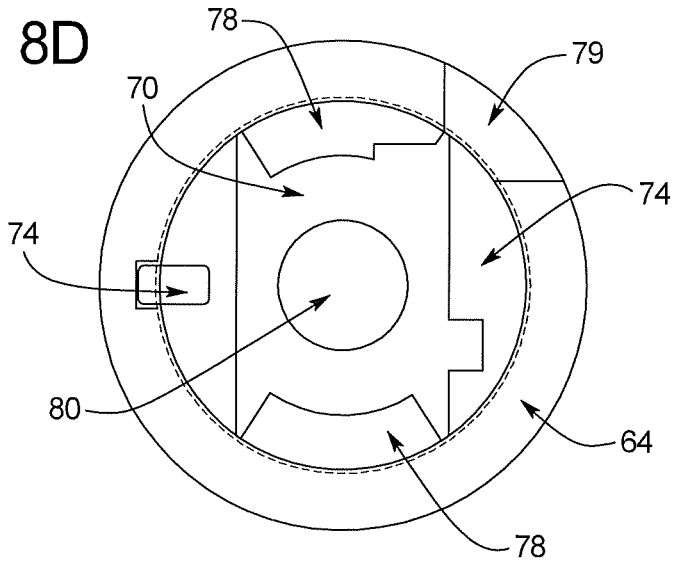
FIG. 8D shows a bottom cross-section view of the configuration of the embodiment of a brush holder assembly shown in FIG. 8C.

As shown in FIGS. 8C and 8D, which depict step (2) of the first method, connection of the brush holder to the support extends the rocker assembly in the post outward through the connecting member. In other embodiments, the handle can be mounted on the brush holder before and/or during this step.

Figure 8E:
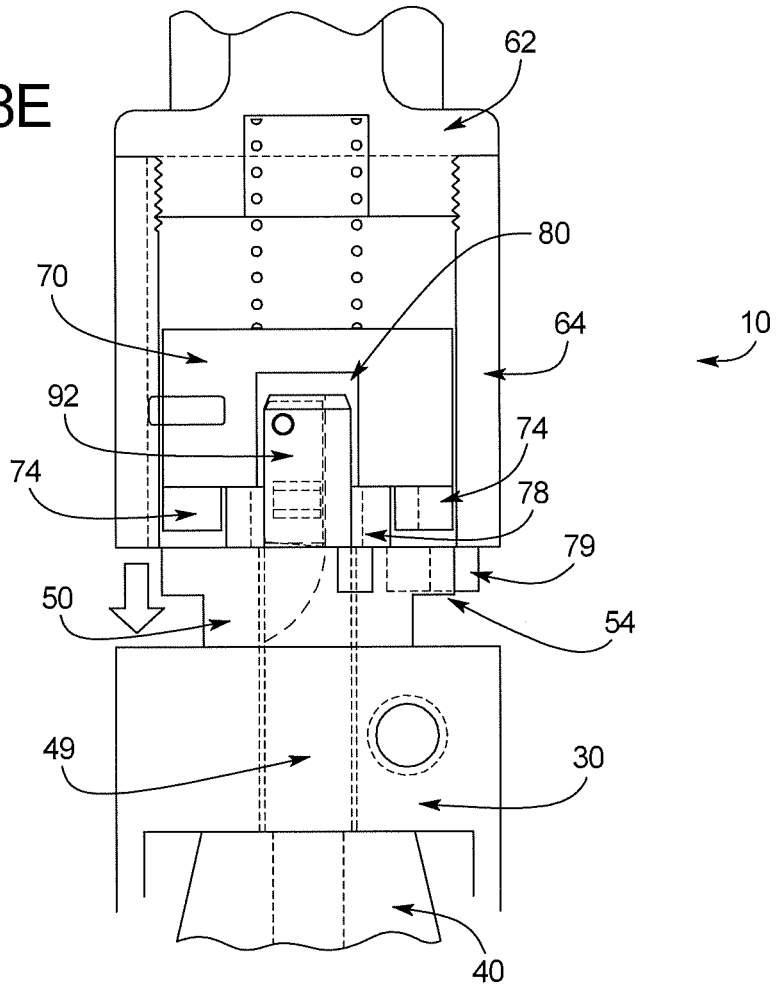
FIG. 8E shows a rear cross-section view of an embodiment of a brush holder assembly provided by the present disclosure.
Figure 8F:
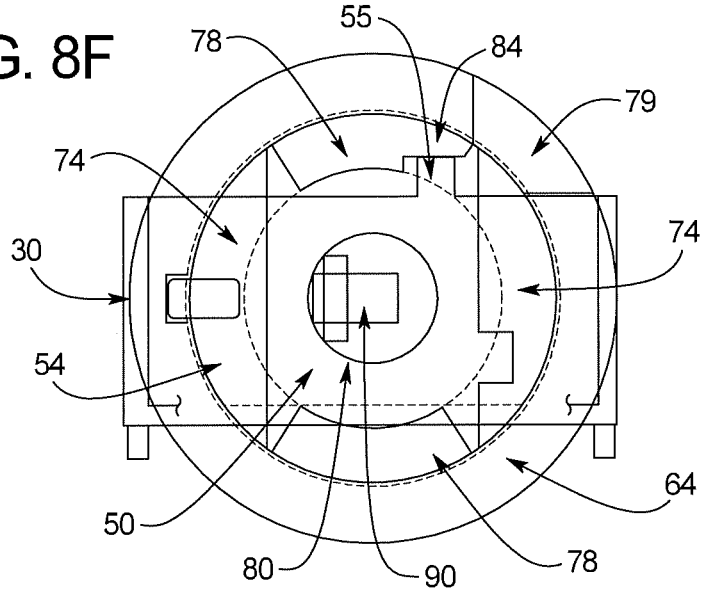
FIG. 8F shows a bottom cross-section view of the configuration of the embodiment of a brush holder assembly shown in FIG. 8E.

As shown in FIGS. 8E and 8F, which depict step (3) of the first method, a user can move the handle to a position directly above the connecting member such that the rocker assembly inserts into the recess 80 of the core of the handle. In one embodiment, one of the shell teeth includes a lateral notch 84. The handle may be rotated until either an "unlock" marking on the handle aligns with indicia (such as a marking or a structure) on the side of the back plate and/or the lateral notch aligns with the boss on the back plate. This position ensures that the handle is located on a proper vertical axis and rotation for connection to the brush holder. In one embodiment, the stop can be positioned adjacent to the rear exterior surface of the back plate.

Figure 8G:
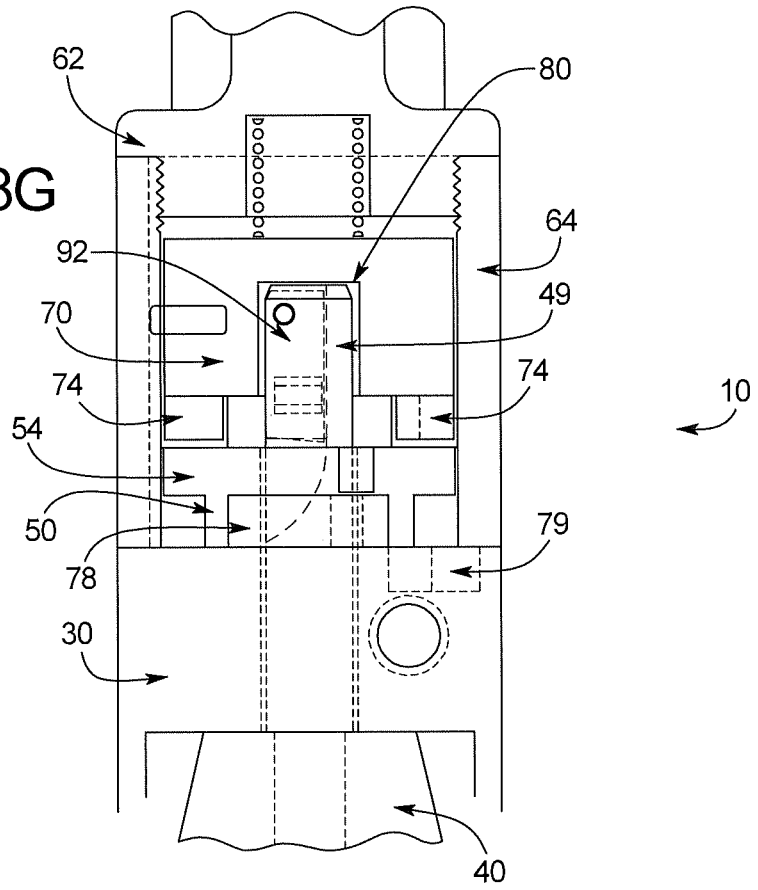
FIG. 8G shows a rear cross-section view of an embodiment of a brush holder assembly provided by the present disclosure.
Figure 8H:
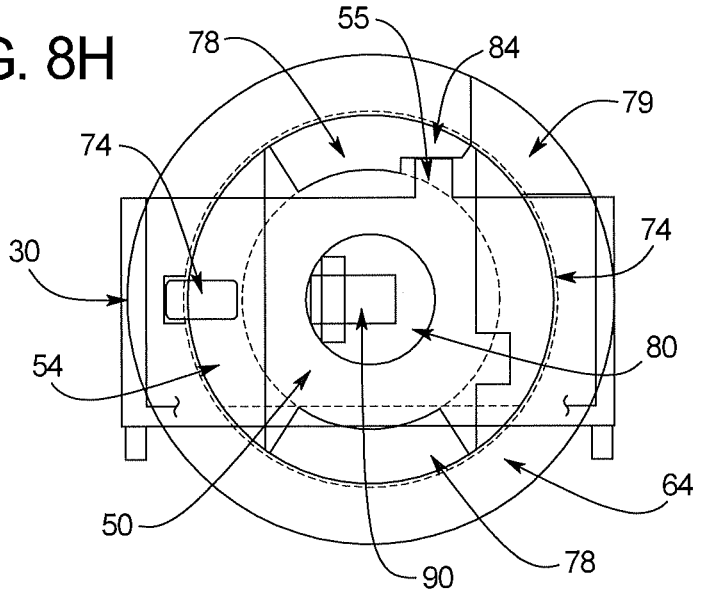
FIG. 8H shows a bottom cross-section view of the configuration of the embodiment of a brush holder assembly shown in FIG. 8G.

As shown in FIGS. 8G and 8H, which depict step (4) of the first method, a user may move/press the handle onto the upper exterior surface of the back plate such that the connecting member is received by the shell teeth of the handle. In an embodiment, the assembly has a single orientation of the shell that is required for the shell to receive the connecting member. For example, as shown in FIG. 8H, insertion of the connecting member into the shell may require that the shell is positioned with the shell teeth offset relative to the locking flange 54 such that the shell teeth do not vertically overlap the locking flange. Insertion of the connecting member into the shell may require that the shell is positioned with the lateral notch aligned with the boss of the locking flange, as shown in FIG. 8H.

After the shell of the handle is positioned as needed for the shell to receive the connecting member, the handle may be moved onto the upper exterior surface of the back plate, thereby sliding the shell teeth past the locking flange as the connecting member is received by the shell. Sliding the shell teeth past the locking flange positions the locking flange in a horizontal plane that is above the horizontal plane of the shell teeth. Sliding the shell teeth past the locking flange can slide the boss through the lateral notch such that the locking flange and the boss 55 move into a horizontal plane that is above the horizontal plane of the shell teeth.

Receipt of the connecting member by the shell may insert the post into the recess 80, thereby pushing the core upward due to force from the post against the biasing of the compression spring 72. For example, the post can push the core upward such that the core moves out of contact with the shell teeth. In one embodiment, the core may be positioned such that the core teeth 74 are in a horizontal plane that is above the horizontal plane of the locking flange which is above the horizontal plane of the shell teeth.

In one embodiment, the connection of the handle to the back plate positions the shell in abutment with the upper exterior surface of the back plate. Positioning the shell in abutment with the upper exterior surface of the back plate includes the shell pushing the one or more pins downward in the back plate to thereby have the one or more pins push the proximal portions 26*c* of the one or more legs 26*a* of the lever downward, such that the lever moves from the first position to the second position to secure the shunt against the pad.

Figure 8I:
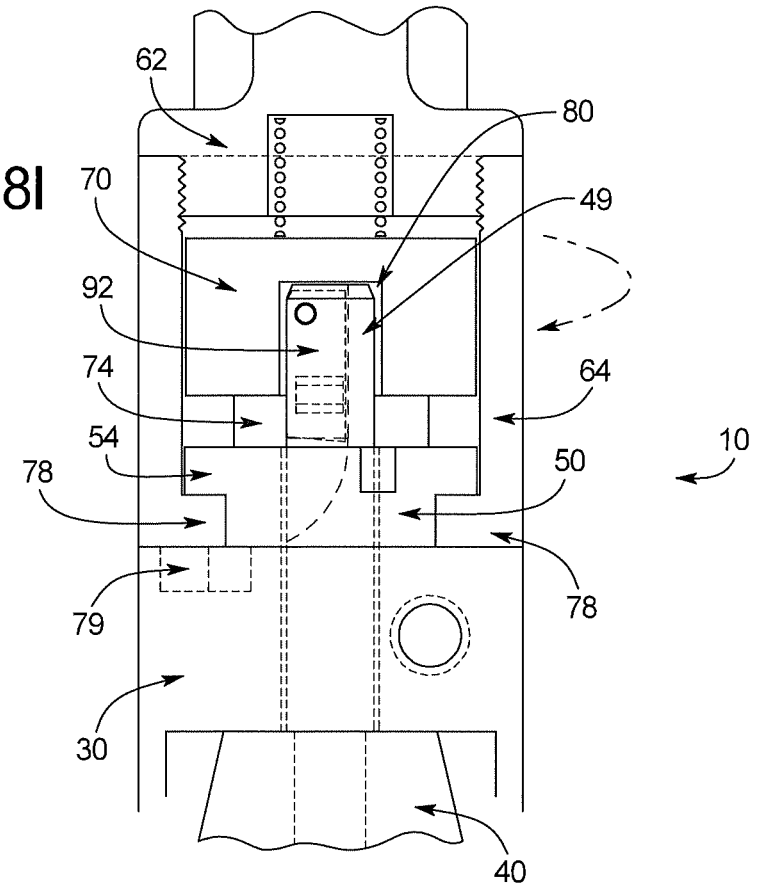
FIG. 8I shows a rear cross-section view of an embodiment of a brush holder assembly provided by the present disclosure.
Figure 8J:
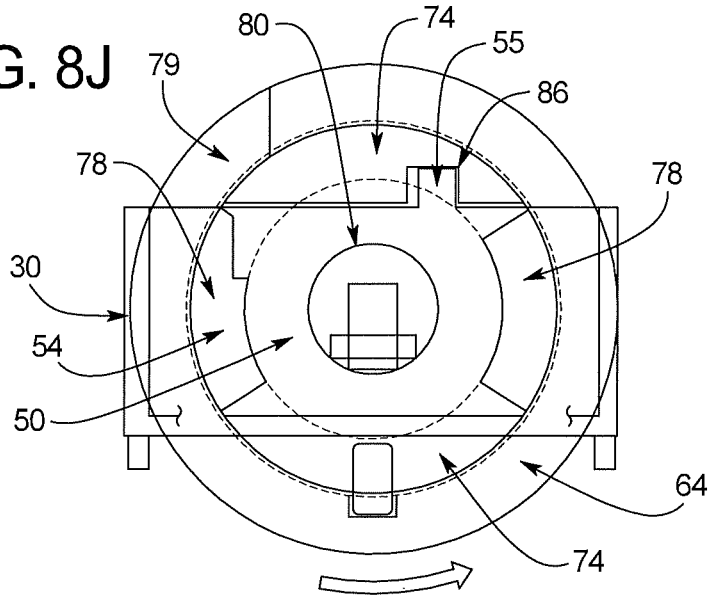
FIG. 8J shows a bottom cross-section view of the configuration of the embodiment of a brush holder assembly shown in FIG. 8I.

As shown in FIGS. 8I and 8J, which depict step (5) of the first method, the handle can be rotated so that the handle is connected to the brush holder. To connect the handle to the back plate of the brush holder, a user may rotate the handle relative to the brush holder. For example, rotating the handle relative to the brush holder can rotate the shell teeth into a position that is underneath and vertically aligned with the locking flange. This rotation can position the shell teeth between the locking flange and the upper exterior surface of the brush holder in a vertical direction. In an embodiment, the handle can rotate about ninety degrees, and further rotation is prevented by contact of the stop with the rear exterior surface 31 of the back plate. This rotational position is the locked position.

In one embodiment, the shell continues to push the one or more pins downward in the back plate during rotation of the handle, such that the one or more pins continue to push the proximal portions 26*c* of the one or more legs 26*a* of the lever downward, such that the lever is maintained in the second position to continuously secure the shunt against the pad.

This rotation of the handle also vertically aligns the boss with a complementary groove 86 in one of the core teeth. In an embodiment, the boss and the complementary groove have substantially the same shape and/or have substantially the same size. With the core pushed upward by the locking flange, the complementary groove 86 is positioned in the same horizontal plane as the core teeth, which is above the horizontal plane in which the locking flange and the boss are positioned. In one embodiment, the boss and groove are rectangular, and complimentary to each other. In other embodiments, the boss and groove are rounded or ovoid, and with the complimentary shape.

Figure 8K:
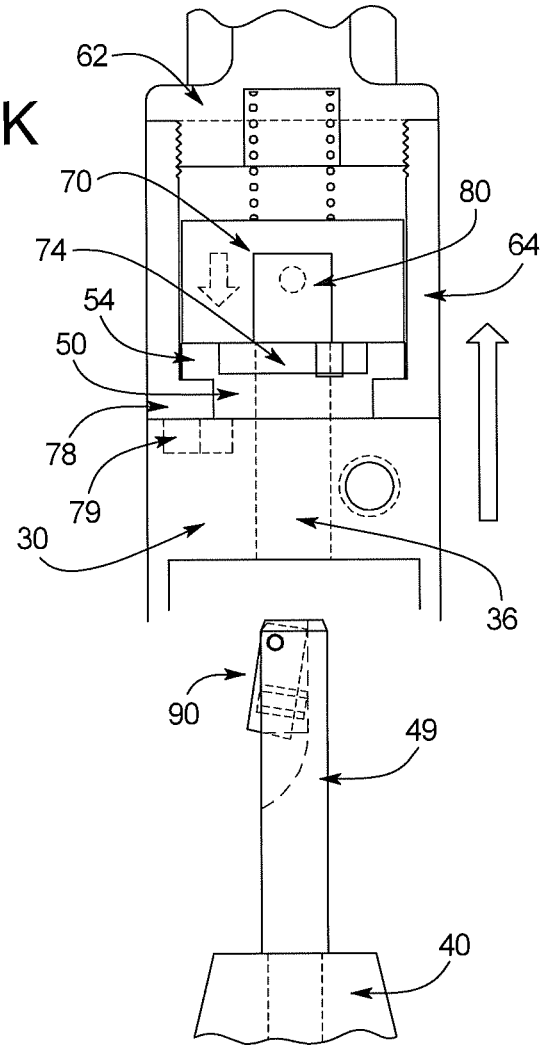
FIG. 8K shows a rear cross-section view of an embodiment of a brush holder assembly provided by the present disclosure.
Figure 8L:
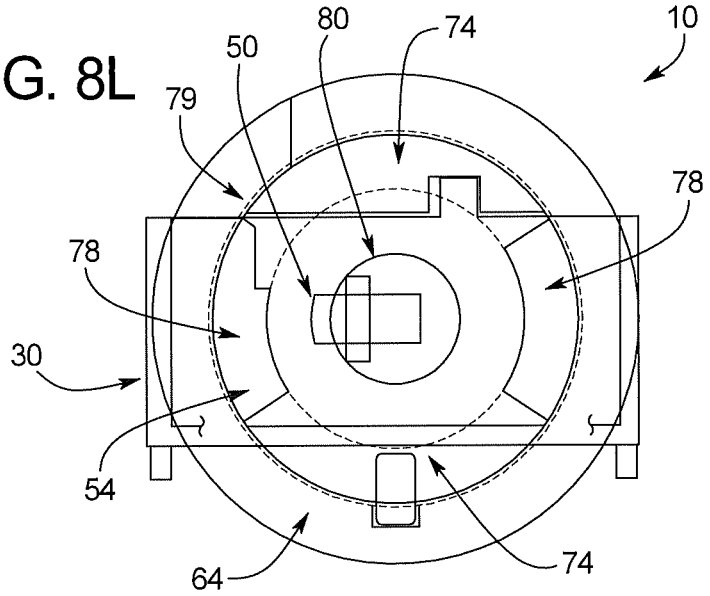
FIG. 8L shows a bottom cross-section view of the configuration of the embodiment of a brush holder assembly shown in FIG. 8K.

As shown in FIGS. 8K and 8L, which depict step (6) of the first method, the brush holder connected to the handle can then be removed from the support to lock the handle to the brush holder. For example, a user may pull the handle upward so that the support slides out of the back plate of the brush holder.

In one embodiment, the shell continues to push the one or more pins downward in the back plate during removal of the brush holder, which is connected to the handle, from the support, such that the one or more pins continue to push the proximal portions 26*c* of the one or more legs 26*a* of the lever downward, such that the lever is maintained in the second position to continuously secure the shunt against the pad.

Removal of the brush holder, which is connected to the handle, from the support removes the post from the recess 80 of the core to allow the core to drop down on the locking flange. The core teeth move into the same horizontal plane as the locking flange, with the inner sides of the core teeth abutting the sides of the locking flange and the groove receiving the boss. This action effectively locks the handle to the brush holder because the compression spring biases the core down onto the connecting member with the boss within the groove and the core teeth preventing rotation of the locking flange. In an embodiment, locking of the handle to the brush holder prevents the handle from being disconnected from the brush holder except by fully seating the brush holder on a support, discussed in further detail hereafter.

As shown in FIGS. 9A-9H, the handle can be disengaged from the back plate is by fully seating the brush holder on the support. These figures depict a second method provided by the present disclosure that can performed subsequently to the method shown in FIGS. 8A-8L, performed prior to the method shown in FIGS. 8A-8L, or performed independently. The steps disclosed hereafter can be performed in any order and are not limited to the specific order shown in the figures. In these figures, the outer dashed line is the perimeter of the locking flange, and the inner, circular dashed line is the perimeter of the connecting member.

Figure 9A:
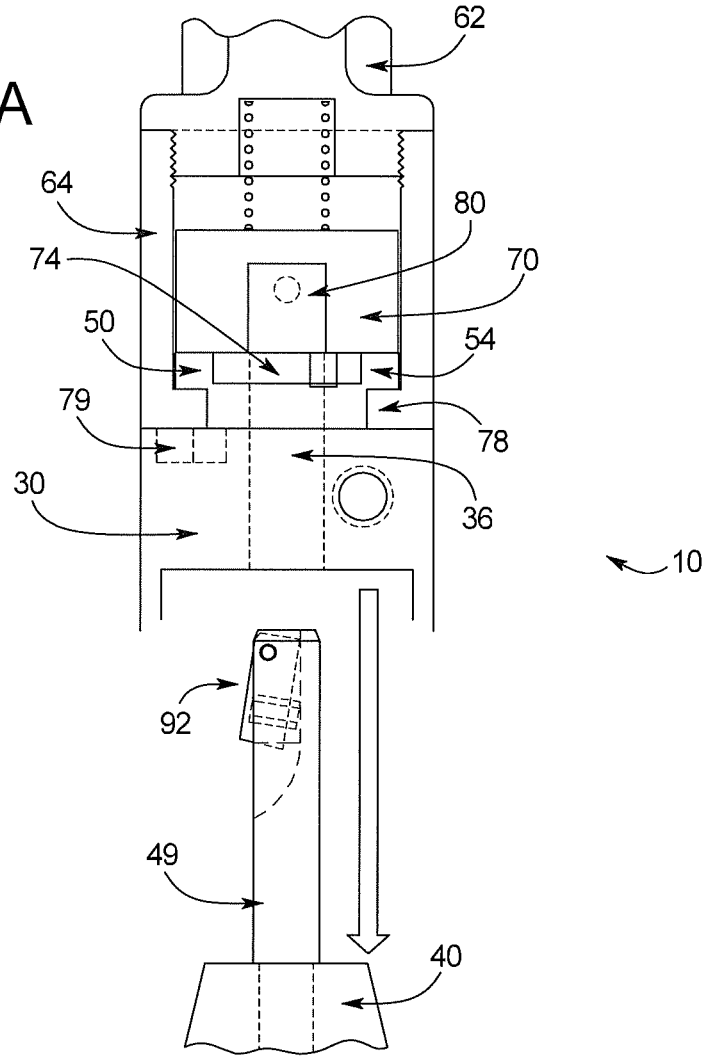
FIG. 9A shows a rear cross-section view of an embodiment of a brush holder assembly provided by the present disclosure.
Figure 9B:
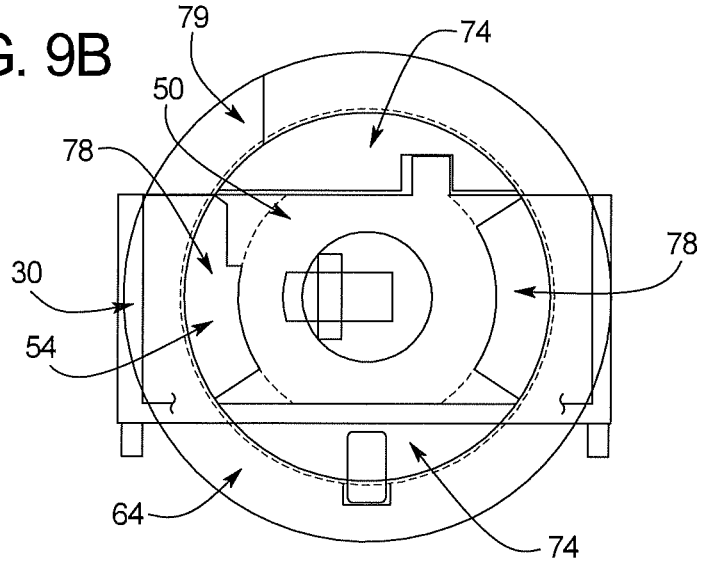
FIG. 9B shows a bottom cross-section view of the configuration of the embodiment of a brush holder assembly shown in FIG. 9A.
Figure 9C:
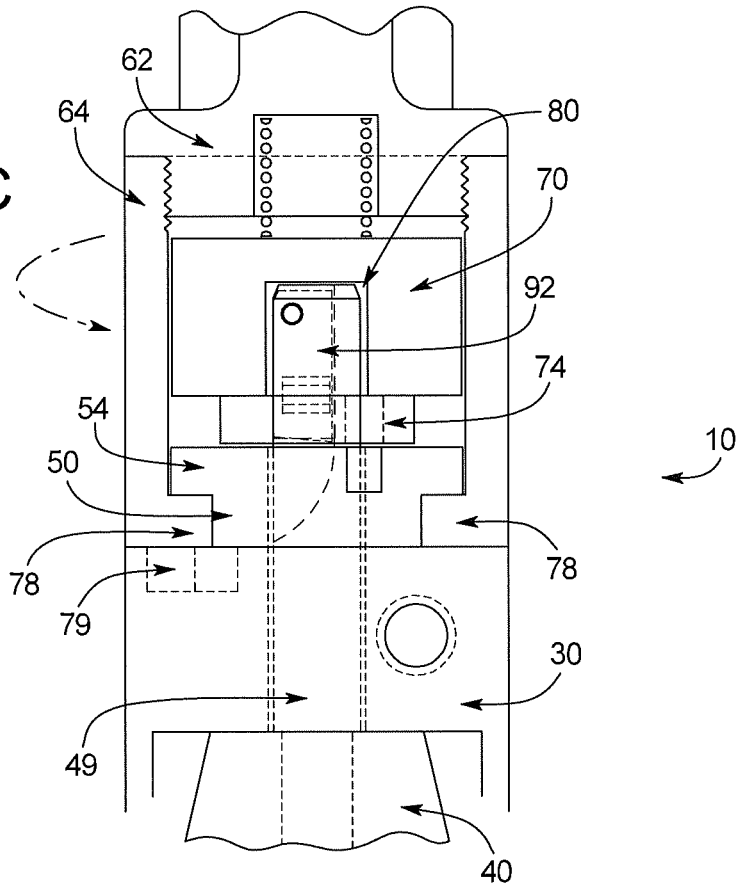
FIG. 9C shows a rear cross-section view of an embodiment of a brush holder assembly provided by the present disclosure.
Figure 9D:
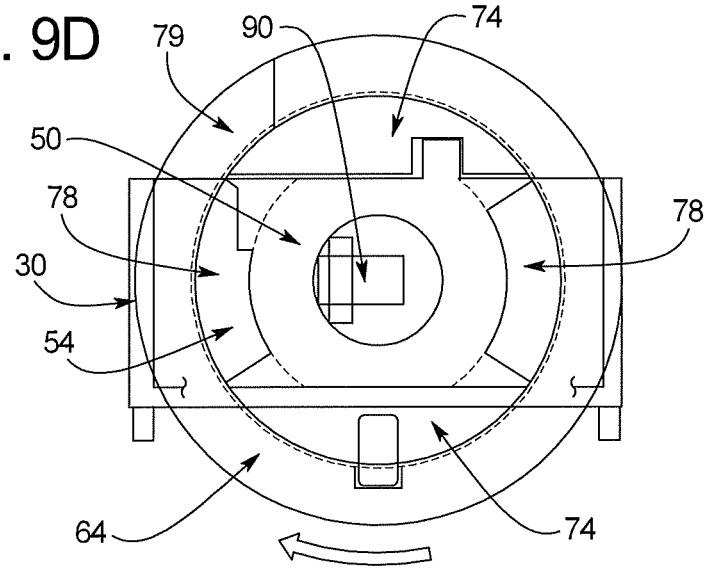
FIG. 9D shows a bottom cross-section view of the configuration of the embodiment of a brush holder assembly shown in FIG. 9C.
Figure 9E:
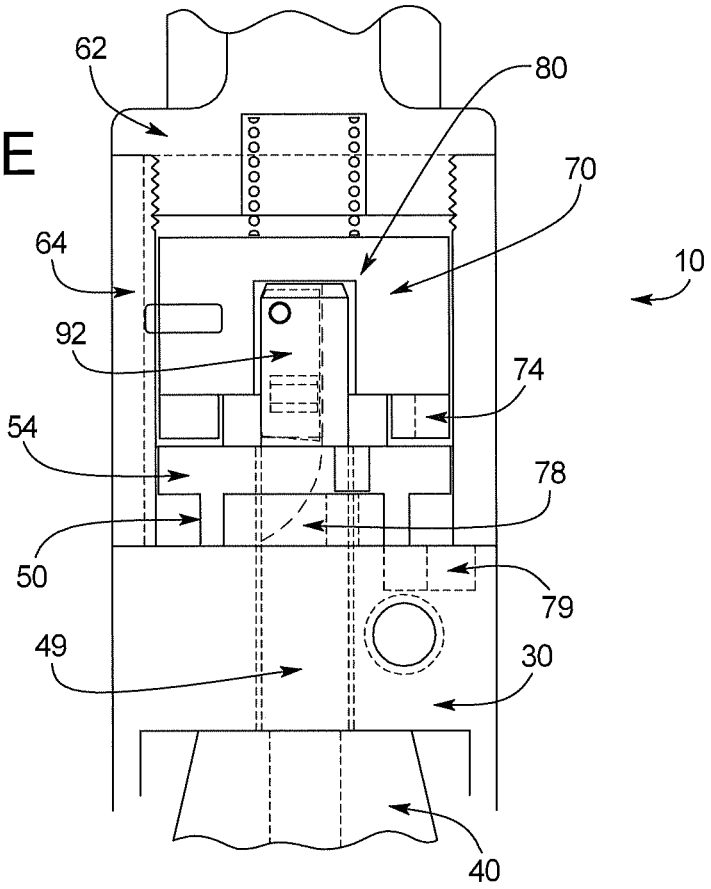
FIG. 9E shows a rear cross-section view of an embodiment of a brush holder assembly provided by the present disclosure.
Figure 9F:
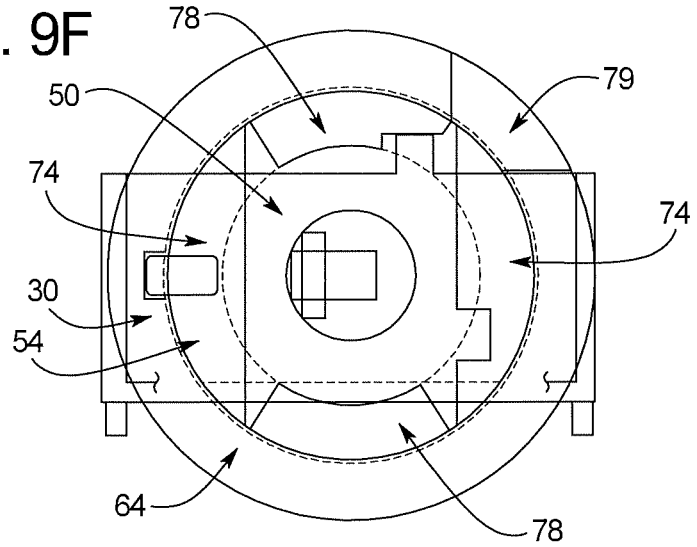
FIG. 9F shows a bottom cross-section view of the configuration of the embodiment of a brush holder assembly shown in FIG. 9E.

As shown in FIGS. 9A and 9B, which depict step (1) of the second method, the brush holder with the handle connected thereto can be aligned with the post of the support. As shown in FIGS. 9C and 9D, which depict step (2) of the second method, the brush holder with the handle connected thereto can be seated onto the support. Seating the brush holder with the handle connected thereto on the support can insert the post into the recess of the core. The post can push the core upward in the cavity, against the bias of the compression spring.

Figure 9G:
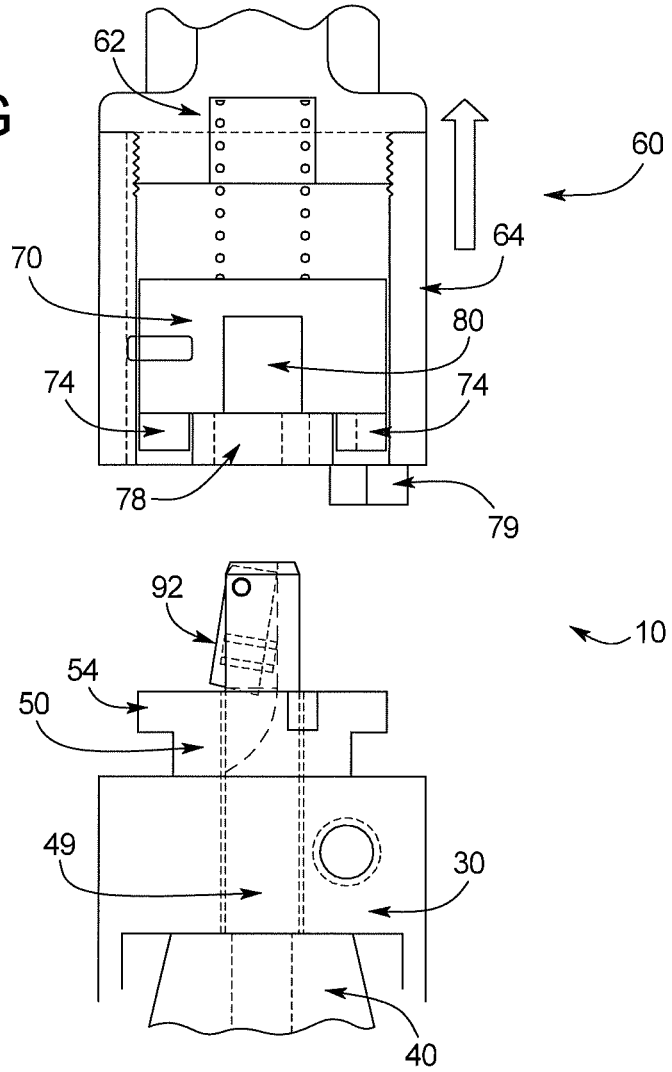
FIG. 9G shows a rear cross-section view of an embodiment of a brush holder assembly provided by the present disclosure.
Figure 9H:
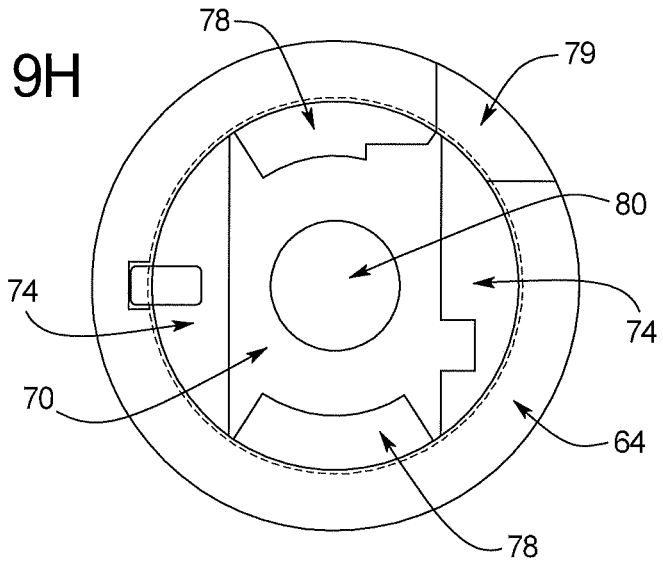
FIG. 9H shows a bottom cross-section view of the configuration of the embodiment of a brush holder assembly shown in FIG. 9G.

This action moves the groove upward, away from the boss, and moves the core teeth upward, away from the locking flange. Thus the handle can then be rotated (step (3) of the second method) from the locked position in which the shell teeth are underneath the locking flange to the unlocked position shown in FIGS. 9E and 9F in which the shell teeth are offset from the locking flange. This unlocked position may allow the handle to be removed from the back plate of the brush holder by lifting the handle from the upper exterior surface of the back plate, as shown in FIGS. 9G and 9H which depict step (4) of the second method. The handle may rotate relative to the brush holder by approximately ninety degrees to move from the unlocked position to the locked position and rotated in the opposite direction by approximately ninety degrees to return the unlocked position.

This action frees the rocker assembly from a restrictive circumference of the recess, allowing the rocker spring to extend and bias the rocker arm outward relative to the post. Extension of the rocker arm outward from the post provides a visual indication that the brush holder is fully seated on the support.

The brush holder assembly can be used in a process for replacing a brush used with a rotating device and/or a process for replacing a brush holder used with a rotating device. One or both of the first and second methods disclosed above can be implemented in a process for replacing a brush used with a rotating device and/or a process for replacing a brush holder used with a rotating device.

Accordingly, the disclosure provides a method of replacing a brush on an operating apparatus, the method includes (a) positioning a handle on a brush holder, in which the brush is at least partially positioned, while the brush holder is connected to a support comprising a post, wherein the positioning of the handle on the brush holder/support assembly inserts the recess in a core moveably positioned in a cavity of the handle into the post and furthermore pushes one or more pins downward in the brush holder to actuate a lever that secures a shunt of the brush against another component of the brush holder; (b) rotating the handle relative to the brush holder in a first direction of handle rotation that is clockwise or counter-clockwise to connect the handle to the brush holder and maintain the lever securing the shunt against the other component of the brush holder; (c) removing the brush holder from the support by pulling the handle with the handle attached to the brush holder, while maintaining the lever securing the shunt against the other component of the brush holder; (d) removing the brush, during which the handle may or may not be attached to the brush holder; (e) positioning a replacement brush at least partially in the brush holder, during which the handle may or may not be attached to the brush holder; (f) using the handle to position the brush holder with the handle attached and with the replacement brush on a support; (g) then rotating the handle in a second direction that is opposite to the first direction to release the handle from the brush holder; (h) then removing the handle from the brush holder, which moves the lever to release the shunt of the brush from being secured between the lever and the other component of the brush.

Step (a) can include one or more of (i) receiving a connecting member located on the brush holder in a shell that forms the base of the handle; (ii) positioning inward-directed horizontal teeth of the handle on opposite sides of a locking flange on the brush holder, (iii) aligning a boss located on a connecting member with a notch in the handle, or (iv) the recess depressing a rocker arm located on the post.

Step (b) can include one or more of (i) rotating the handle approximately ninety degrees relative to the brush holder, (ii) limiting the handle rotation to about ninety degrees, (iii) rotating inward-directed horizontal teeth of the handle from a position offset relative to a locking flange on the brush holder to a position underneath the locking flange in a vertical direction, (iv) rotating downward-directed teeth in the handle from a position vertically overlapping a locking flange located on the brush holder to a position offset relative to the locking flange, or (v) vertically aligning a boss on a connecting member located on the brush holder with a complementary groove provided by the core.

Step (c) can include one or more of (i) removing the brush holder from the post, (ii) removing the recess in the core from the post, (iii) aligning a complementary groove provided by the core to pass by a boss located on a connecting member, (iv) sliding the core downward in the cavity, or (iv) releasing a rocker arm on the post as the core recess is removed. Step (e) can include positioning a portion of the shunt of the brush between the distal portion of the lever and the pad of the back plate. Step (f) can include one or more of (i) sliding the brush holder onto the post, (ii) receiving the post in the recess of the core, or (iii) the recess depressing a rocker arm located on the post. Step (g) can include one or more of (i) rotating the handle approximately ninety degrees relative to the brush holder, (ii) rotating inward-directed horizontal teeth of the handle from a position underneath the locking flange on the brush holder in a vertical direction to a position offset relative to a locking flange located on the brush holder, (iii) rotating downward-directed teeth in the handle from a position offset relative to the locking flange to a position vertically overlapping a locking flange on the brush holder, (iv) limiting the handle rotation to about ninety degrees, or (v) moving a connecting member on the brush holder out of vertical alignment with a complementary groove provided by the core.

Step (h) can include one or more of (i) removing the post from the recess in the core, (ii) sliding the core downward in the cavity, (iv) the recess releasing a rocker arm on the post, or (v) interlocking the handle so the handle is not removable until the brush holder is completely seated on the support.

The disclosure provides a method of replacing a brush holder, the method comprising (a) positioning a handle on the brush holder while the brush holder is connected to a support comprising a post, wherein the positioning of the handle on the brush holder inserts the post into a recess in a core moveably positioned in a cavity of the handle and furthermore pushes one or more pins downward in the brush holder to actuate a lever that secures a shunt of the brush against another component of the brush holder; (b) rotating the handle relative to the brush holder in a first direction that is clockwise or counter-clockwise to connect the handle to the brush holder and maintain the lever securing the shunt against the other component of the brush holder; (c) removing the brush holder from the support by pulling the handle while the handle is attached to the brush holder, while maintaining the lever securing the shunt against the other component of the brush holder; (d) rotating the handle relative to the brush holder while pulling a trigger on the handle that moves the core upward in the cavity; (e) removing the handle from the brush holder, which moves the lever to release the shunt of the brush from being secured between the lever and the other component of the brush; (f) positioning the handle on a replacement brush holder; (g) rotating the handle relative to the replacement brush holder to connect the handle to the replacement brush holder; (h) using the handle to position the replacement brush holder on the support; (i) then rotating the handle in a second direction that is opposite to the first direction; and (j) then removing the handle from the replacement brush holder.

As used herein, "upward" means in a direction substantially toward the top of FIGS. 1A-1C with the assembly positioned as shown in these figures, "downward" means in a direction substantially toward the bottom of FIGS. 1A-1C with the assembly positioned as shown in these figures, "vertical" means the direction from the top to the bottom of FIGS. 1A-1C with the assembly positioned as shown in these figures, and "horizontal" means the direction from the left side to the right side of FIGS. 1A-1C with the assembly positioned as shown in these figures.

As used in this disclosure and the appended claims, the singular forms "a," "an" and "the" include plural referents unless the context clearly dictates otherwise. The words "comprise," "comprises" and "comprising" are to be interpreted inclusively rather than exclusively. Likewise, the terms "include," "including" and "or" should all be construed to be inclusive, unless such a construction is clearly prohibited from the context. However, the devices and assemblies disclosed herein may lack any element that is not specifically disclosed. Thus, a disclosure of an embodiment using the term "comprising" includes a disclosure of embodiments "consisting essentially of" and "consisting of" the components identified. Any embodiment disclosed herein can be combined with any other embodiment disclosed herein unless explicitly indicated otherwise. "Substantially the same" and "approximately" with respect to numerical values means within 10%, within 5%, more within 1%, or within 0.1%. For example, "substantially perpendicular" means at an angle between 81 degrees and 99 degrees (inclusive), between 85.5 degrees and 94.5 degrees (inclusive), or between 89 degrees and 91 degrees (inclusive). Furthermore, all numerical ranges herein should be understood to include all integers, whole or fractions, within the range. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth. A "fixed position" means that the referenced component can move at most 10.0 millimeters relative to the initial position, 5.0 millimeters relative to the initial position, or at most 2.0 millimeters relative to the initial position.

Changes and modifications to the embodiments described herein will be apparent to those of ordinary skill in the art. Such changes and modifications can be made without departing from the scope of the subject matter and the appended claims. Such changes and modifications are covered by the appended claims.

The invention claimed is:

1. A brush holder assembly comprising:

a brush holder comprising a brush box configured to receive a brush, the brush holder further comprising a back plate fixed to the brush box; and a lever connected to the back plate, the lever is configured to reversibly and selectively rotate between a first position and a second position, wherein the lever comprises a distal portion positioned at a distance from the back plate, and the distance between the back plate and the distal portion of the lever is greater in the first position relative to the distance between the back plate and the distal portion of the lever in the second position, wherein the brush holder assembly further comprises:

one or more pins at least partially inserted in the back plate and configured to engage a proximal portion of the lever that is at an opposite end of the lever from the distal portion, wherein the back plate comprises an upper exterior surface, and the one or more pins extend at least partially through the upper exterior surface; and a handle configured to connect to a connecting member positioned on the upper exterior surface of the back plate, wherein the one or more pins are positioned such that connection of the handle to the connecting member pushes the one or more pins downward relative to the upper exterior surface.

2. The brush holder assembly of claim 1 wherein the one or more pins are aligned with the proximal portion of the lever such that the handle pushing the one or more pins downward relative to the upper exterior surface concurrently pushes the proximal portion of the lever downward.

3. The brush holder assembly of claim 2 wherein the lever comprises one or more legs connected to the distal portion of the lever, the one or more legs also defining the proximal portion of the lever, each of the one or more legs comprises a pivot between the distal portion and the proximal portion, and the pivot is configured such that the one or more pins pushing the proximal portion of the lever downward rotates the distal portion of the lever upward into the second position of the lever.

4. The brush holder assembly of claim 3 wherein the one or more pins are spring-biased upward such that removing the handle from the connecting member moves the one or more pins upward in the back plate.

5. The brush holder assembly of claim 4 wherein the lever is configured such that the one or more pins moving upward in the back plate moves the proximal portion of the lever upward to thereby rotate the distal portion of the lever downward into the first position of the lever.

6. A system comprising:

a brush from which a shunt extends, the shunt comprises a first end and a second end that define a length of the shunt, the first end of the shunt is connected to the brush;

a brush holder comprising a brush box configured to receive the brush, the brush holder further comprising a back plate fixed to the brush box; and a lever connected to the back plate, the lever is configured to reversibly and selectively rotate between a first position and a second position, wherein the lever comprises a distal portion, and the second position of the lever is configured to secure a portion of the shunt between the distal portion of the lever and another component of the brush holder.

7. The system of claim 6 wherein the other component of the brush holder, against which the shunt is secured by the lever in the second position, comprises a pad on the back plate.

8. The system of claim 7 wherein the shunt has a thickness, and a distance from the pad to the distal portion of the lever in the second position is substantially equal to the thickness of the shunt, and a distance from the pad to the distal portion of the lever in the first position is greater than and not substantially equal to the thickness of the shunt.

9. The system of claim 7 wherein the brush holder comprises an electrical connector configured to receive the second end of the shunt.

10. The system of claim 9 wherein the electrical connector is positioned on an exterior surface of the brush box on an opposite side of the brush box from the back plate.

11. The system of claim 7 further comprising a spring configured to push downward on a top surface of the brush received by the brush box, the brush holder is configured to fixedly position the brush in the brush box by a combination of (i) the spring pushing downward on the top surface of the brush and (ii) the lever in the second position securing the portion of the shunt between the lever and the other component such that a section of the shunt extending from the first end of the shunt to the portion of the shunt secured between the lever and the other component is taut.

12. A method of replacing a brush to which a first end of a shunt is connected, the method comprising:

positioning a handle on a brush holder while the brush holder is connected to a support, the brush is at least partially positioned in a brush box provided by the brush holder, and the positioning of the handle on the brush holder actuates a lever that secures a portion of the shunt in a fixed position between a distal portion of the lever and another component of the brush holder;

rotating the handle relative to the brush holder in a first direction selected from the group consisting of clockwise and counter-clockwise to connect the handle to the brush holder, the lever maintains the portion of the shunt in the fixed position between the distal portion of the lever and the other component of the brush holder during the rotating of the handle in the first direction;

removing the brush holder from the support by pulling the handle with the handle attached to the brush holder, the lever maintains the portion of the shunt in the fixed position between the distal portion of the lever and the other component of the brush holder during the removing of the brush holder from the support; and removing the brush from the brush holder.

13. The method of claim 12 further comprising:

positioning a replacement brush at least partially in the brush holder;

using the handle to position the brush holder, with the replacement brush, on the support;

rotating the handle relative to the brush holder in a second direction that is opposite to the first direction; and removing the handle from the brush holder, the removing of the handle from the brush holder releases the portion of the shunt from the fixed position between the distal portion of the lever and the other component of the brush holder.

14. The method of claim 12 wherein:

the brush holder further comprises a spring that continuously pushes downward on a top surface of the brush during the positioning of the handle on the brush holder, the rotating of the handle, and the removing of the brush holder from the support; and the brush holder fixedly positions the brush in the brush box during the positioning of the handle on the brush holder, the rotating of the handle, and the removing of the brush holder from the support, by a combination of (i) the spring continuously pushing downward on the top surface of the brush and (ii) the lever securing the portion of the shunt in the fixed position between the distal portion of the lever and the other component of the brush holder such that a section of the shunt extending from the first end of the shunt to the portion of the shunt between the lever and the other component is taut.

15. The method of claim 14 wherein the brush is held in the fixed position without any component of the brush holder contacting a bottom surface of the brush and without any component of the brush holder pushing a side surface of the brush.

16. A brush holder system, comprising:

means for positioning a handle on the brush holder while the brush holder is connected to a support, and the positioning of the handle on the brush holder actuates a lever provided by the brush holder from a first position to a second position;

means for rotating the handle relative to the brush holder in a first direction selected from the group consisting of clockwise and counter-clockwise to connect the handle to the brush holder, and the lever is maintained in the second position during the rotating of the handle;

means for removing the brush holder from the support, and the lever is maintained in the second position during the removing of the brush holder from the support;

means for rotating the handle relative to the brush holder while pulling a trigger on the handle that moves a core in the handle upward in a cavity in the handle; and means for removing the handle from the brush holder, the removing of the handle from the brush holder returns the lever to the first position.

* * * * *